US010344560B2

(12) United States Patent
Arabsky et al.

(10) Patent No.: US 10,344,560 B2
(45) Date of Patent: Jul. 9, 2019

(54) WELLBORE TOOL WITH PRESSURE ACTUATED INDEXING MECHANISM AND METHOD

(71) Applicant: INTERRA ENERGY SERVICES LTD., Calgary (CA)

(72) Inventors: Serhiy Arabsky, Beaumont (CA); Vitaliy Arabsky, Beaumont (CA)

(73) Assignee: INTERRA ENERGY SERVICES LTD., Calgary, AB (CA)

( * ) Notice: Subject to any disclaimer, the term of this patent is extended or adjusted under 35 U.S.C. 154(b) by 6 days.

(21) Appl. No.: 15/525,874

(22) PCT Filed: Nov. 10, 2015

(86) PCT No.: PCT/CA2015/051162
§ 371 (c)(1),
(2) Date: May 10, 2017

(87) PCT Pub. No.: WO2016/074078
PCT Pub. Date: May 19, 2016

(65) Prior Publication Data

US 2018/0328144 A1 Nov. 15, 2018

Related U.S. Application Data

(60) Provisional application No. 62/078,090, filed on Nov. 11, 2014.

(51) Int. Cl.
*E21B 23/00* (2006.01)
*E21B 34/00* (2006.01)
(Continued)

(52) U.S. Cl.
CPC ..... *E21B 34/10* (2013.01); *E21B 23/006* (2013.01); *E21B 34/14* (2013.01); *E21B 43/26* (2013.01); *E21B 2034/007* (2013.01)

(58) Field of Classification Search
CPC ..... E21B 34/10; E21B 43/26; E21B 23/006; E21B 2034/007
See application file for complete search history.

(56) References Cited

U.S. PATENT DOCUMENTS 3,442,328 A * 5/1969 Nutter ..... E21B 23/006 166/152
4,355,685 A * 10/1982 Beck ..... E21B 23/006 166/240

(Continued)

FOREIGN PATENT DOCUMENTS

WO 2010/127457 A1 11/2010

OTHER PUBLICATIONS

International Search Report and Written Opinion dated Jan. 21, 2016, issued in corresponding International Application No. PCT/CA2015/051162, filed Nov. 10, 2015, 8 pages.

*Primary Examiner* — James G Sayre

(57) ABSTRACT

Pressure activated counting/indexing mechanisms for hydraulic fracturing sleeves and related processes are provided. The hydraulic fracturing apparatuses can include a tubular body having a housing and a flow port, a movable inner sleeve within the tubular body slidable from a first position blocking the flow port and a second position exposing the flow port; an inner indexing mechanism capable of being moved through a plurality of positions and can include the inner sleeve having a counting track comprising a plurality of different grooves; and a counting mechanism that can include a circular ring and pin that can be axially and rotationally movable in the counting track; an actuating mechanism can rely on the auto-jay counting mechanism to provide a mechanical signal to either allow an actuating member to pass through and not open the flow ports or be retained so pressure shifts the sleeve to open the flow ports.

21 Claims, 28 Drawing Sheets

(51) Int. Cl.

| | |
|---|---|
| ***E21B 34/10*** | (2006.01) |
| ***E21B 34/14*** | (2006.01) |
| ***E21B 43/26*** | (2006.01) |

(56) References Cited

U.S. PATENT DOCUMENTS

| | | | | |
|---|---|---|---|---|
| 4,403,659 | A * | 9/1983 | Upchurch | E21B 34/10 166/321 |
| 6,378,612 | B1 * | 4/2002 | Churchill | E21B 21/103 166/319 |
| 8,783,365 | B2 * | 7/2014 | McCoy | E21B 43/26 166/318 |
| 2009/0308588 | A1 | 12/2009 | Howell et al. | |
| 2012/0261131 | A1 | 10/2012 | Hofman et al. | |
| 2013/0025882 | A1 * | 1/2013 | Streich | E21B 41/00 166/381 |
| 2013/0118732 | A1 * | 5/2013 | Chauffe | E21B 34/06 166/250.04 |
| 2013/0248201 | A1 * | 9/2013 | Jackson | E21B 34/14 166/373 |
| 2014/0158361 | A1 * | 6/2014 | Cheng | E21B 23/006 166/308.1 |
| 2016/0032697 | A1 * | 2/2016 | Harris | E21B 43/12 166/373 |

* cited by examiner

WELLBORE TOOL WITH PRESSURE ACTUATED INDEXING MECHANISM AND METHOD

CROSS REFERENCE TO RELATED APPLICATIONS

This application claims priority of U.S. Provisional Patent Application Ser. No. 62/078,090, entitled "Wellbore Tool with Pressure Actuated Indexing Mechanism and Method", filed Nov. 11, 2014, and hereby incorporated by reference herein in its entirety.

TECHNICAL FIELD

The present disclosure is related to the field of methods and apparatus of completion tools, in particular, methods and apparatus of pressure activated indexing completion tools for hydraulic fracturing.

BACKGROUND

The technique of hydraulic fracturing (commonly referred to as "fracing" or "fracking") is used to increase or restore the rate at which fluids, such as oil or gas, can be produced from a reservoir or formation, including unconventional reservoirs such as shale rock or coal beds. Fracing is a process that results in the creation of fractures in rocks. The most important industrial use of fracing is to increase the rate and ultimate recovery of oil and natural gas by stimulating oil and gas wells; usually the fracturing is done from a wellbore drilled into reservoir rock formations.

Hydraulic fractures may be created or extended by internal fluid pressure which opens the fracture and causes it to extend through the rock.

Hydraulic fractures may be created or extended by internal fluid pressure which opens the fracture and causes it to extend through the rock. Fluid-driven fractures are formed at depth in a borehole and can extend into targeted formations. The fracture height or width is typically maintained after the injection by introducing an additive or a proppant along with the injected fluid into the formation. The fracturing fluid has two major functions, to open and extend the fracture; and to transport the proppant along the length or height of the fracture.

In a multi stage well treatment, multiple zones within a well are created by deploying a treatment string using ports that can allow treatment fluid to flow from the treatment string into the formation. The treatment string can have a multitude of packers that can be set between each of the ports to create isolated zones, thus forming a barrier during each fracturing treatment. Each port is selectively opened by a ball, plug, or dart that is pumped from surface; the ball, plug or a dart lands onto a seat that is located inside each of the ports. By increasing the pressure behind the ball, plug, or dart, after it has landed on the seat, enough force can be created to shift the seat and open the port (allowing the pressure from inside the tubing to contact the formation). Each seat in the port can be sized to accept a ball of a certain diameter but at the same time allow balls of a smaller diameter to pass. A disadvantage to this system is that as different sized balls must be used for each portion; there is a practical limit to the number of portions that the bore can be divided into.

Current fracing systems and methods can be problematic and inefficient. For example, current ball drop systems suffer from the same restrictions on the size limitation of the internal diameter of the treatment string. In some cases, if the largest internal diameter of a ball that is allowed 3.750", and assuming ⅛" increments of change in ball diameter, a well will be limited to having an approximate maximum of twenty-four stages.

There have been attempts and developments to increase the number of zones in a well by introducing indexing mechanisms that have a multitude of inactive positions and one active position. These mechanisms use a ball or a dart to force the seat into different indexing positions. These mechanical counting mechanisms, however are complex have been used with limited success.

Further mechanical attempts to provide a mechanical counter are disclosed in Canadian Patent Nos. 2,844,342 and 2,794,331. These mechanisms rely on a ball or the force of the ball to shift a seat downstream in order to place a counter into the next position. Since the ball can land on the seat of the tool at a high velocity, the impact that is created has a potential of damaging the mechanism. In addition, these mechanisms provide no positive feedback via a pressure signature to surface (which is an important diagnostic function that provides feedback as to whether all of the tools are counting correctly). For example, as the ball passes through each tool at high velocity, the impact and pressure behind the ball would not stop the ball for long enough for a pressure increase to be detected at surface. Also, the mechanism (particularly the counting grooves) is fully exposed to debris during cementing and fracing operations, which could all cause the counter to jam, skip or fail. It is therefore desirable to provide more reliable tools and methods that do not rely on mechanical forces to move counters into their designed states. It is therefore also desirable to provide more reliable tools and methods that provide positive feedback regarding the counting function, and are protected from debris.

The methods and apparatuses currently available have their shortcomings. Accordingly, there is a need to provide a tool and method that overcome the disadvantages of the prior art. In addition, it is desirable to provide more reliable tools and methods that do not rely on the direct mechanical force of a ball against a seat to move a seat into different counting positions.

SUMMARY

Methods and apparatus of pressure activated counting/indexing mechanisms for hydraulic fracturing sleeves and related processes are provided. In some embodiments, the hydraulic fracturing apparatuses for accessing subterranean formations can include a tubular body fluidly connectable in-line with a completion string having an upstream and a downstream, the tubular body can have a housing with a flow port in the sidewall. An inner indexing mechanism can be disposed within the housing, where the inner indexing mechanism can include an indexing sleeve, a counting mechanism, and a biasing member. An actuating mechanism can be disposed within the sleeve and, when activated by an appropriately sized actuating member, can be used to move the counting mechanism through a plurality of positions. In some embodiments, the apparatus can also comprise a locking mechanism for preventing the sleeve from shifting prematurely.

Broadly stated, in some embodiments, an apparatus is provided comprising: a tubular housing for connecting in-line with a completion string, the housing having an upper end and a lower end, a wall defining an inner bore and an outer surface, and a flow port through the wall of the tubular housing; an inner indexing mechanism disposed within the inner bore of the housing, the inner indexing mechanism comprising; an indexing sleeve having an outer diameter with a counting track disposed around the outer diameter; a counting mechanism, configured for being moved through a plurality of positions, the counting mechanism comprising a pin and a ring for being disposed concentrically around the indexing sleeve, wherein the pin is configured for tracing the counting track; and a biasing member configured to urge the counting mechanism to trace the counting track; and an actuating mechanism disposed within the indexing sleeve and configured to overcome the biasing member and move the counting mechanism through a plurality of positions, the actuating mechanism being configured to be activated by an accordingly sized actuating member.

In some embodiments, the inner indexing mechanism is a sliding sleeve assembly movable to open and close the flow port through the wall of the tubular housing. In some embodiments, the counting track comprises a series of axial auto-jay grooves. In some embodiments, the actuating mechanism comprises an expandable seat in the inner sleeve; wherein the expandable seat is configured to either receive and release, or receive and retain, the accordingly sized actuating member dependent on a predetermined position of the counting mechanism. In some embodiments, the expandable seat is a split collet. In some embodiments, the expandable seat comprises and expandable seat housing and dogs which extend radially into the inner bore to create a seat. In some embodiments, the dogs are angled to cradle the actuating member and increase the contact area between the dogs and the actuating member. In some embodiments, the actuating member is configured for activating the actuating mechanism as well as moving the inner indexing mechanism to a predetermined position. In some embodiments, the series of axial auto-jay grooves comprises a series of grooves configured for maintain the inner indexing mechanism in an inactivate position and at least one groove for activating the inner mechanism. In some embodiments, the counting mechanism is configured to progress within the auto-jay grooves towards an active groove in a predetermined number of steps by passage of a corresponding number of actuating members through the actuating mechanism. In some embodiments, the series of axial auto-jay grooves further comprise a backswing groove to allow the counting mechanism to undergo a backswing prior to entering an active position. In some embodiments, the biasing member is a spring. In some embodiments, the biasing member is compressed fluid. In some embodiments, the actuating member is selected from the group consisting of a ball, a plug, and a dart. In some embodiments, the apparatus further comprises a locking mechanism for preventing the sleeve from shifting prematurely.

Broadly stated, in some embodiments, a method of fracturing a wellbore is provided, the method comprising: providing at least one apparatus, as described herein, in line with a completion string and within the wellbore; creating an isolated wellbore segment around the apparatus; providing an accordingly sized actuating member to the apparatus to activate the actuating mechanism; opening the flow port of the apparatus; and providing pressurised fluid to the apparatus to exit the opened flow port; wherein the wellbore is thereby fractured by the pressurized fluid.

In some embodiments, the actuating member is configured to activate the actuating mechanism as well as configured to move the inner indexing mechanism. In some embodiments, when the counting mechanism is positioned in an inactive groove within the series of grooves, the expandable seat is configured to receive and release the corresponding actuating member. In some embodiments, when the counting mechanism is positioned in an active groove within the series of grooves, the expandable seat is configured to receive and retain the corresponding actuating member. In some embodiments, the inner indexing mechanism is movable by landing an actuating member in an expandable seat that is configured to receive and retain the actuating member. In some embodiments, the method further comprises: providing an additional apparatus, as described herein, in line with the completion string and within the wellbore; creating an isolated wellbore segment around the additional apparatus; providing an accordingly sized actuating member to the additional apparatus to activate the actuating mechanism; opening the flow port of the additional apparatus; and providing pressurised fluid to the additional apparatus to exit the opened flow port; wherein the wellbore is thereby fractured in a targeted manner by the pressurized fluid.

Broadly stated, in some embodiments, a method is provided for actuating a downhole tool to an active position, the method comprising: providing an actuating member onto an actuating mechanism disposed within the tool; generating a pressure difference upstream versus downstream of the actuating member; moving a counting mechanism against a biasing member into an inactive auto-jay groove on an inner indexing mechanism; releasing the actuating member from the actuating mechanism; biasing the counting mechanism away from the biasing member along a groove of a series of axial auto-jay grooves; repeating above steps until the counting mechanism reaches an active groove, whereby the downhole tool is actuated to an active position.

In some embodiments, the method can further comprise positioning the counting mechanism in an active groove; setting an expandable seat to receive and retain the actuating member; landing the actuating member upon the expandable seat; moving an inner indexing mechanism sliding sleeve assembly; opening fluid ports in the tool; and allowing pressurised fluid access to an annulus between the downhole tool and a wellbore; wherein the wellbore is thereby fractured by the pressurized fluid. In some embodiments, the method can further comprise preventing moving the inner indexing mechanism prior to a final cycle by using a locking mechanism.

Figure 1:
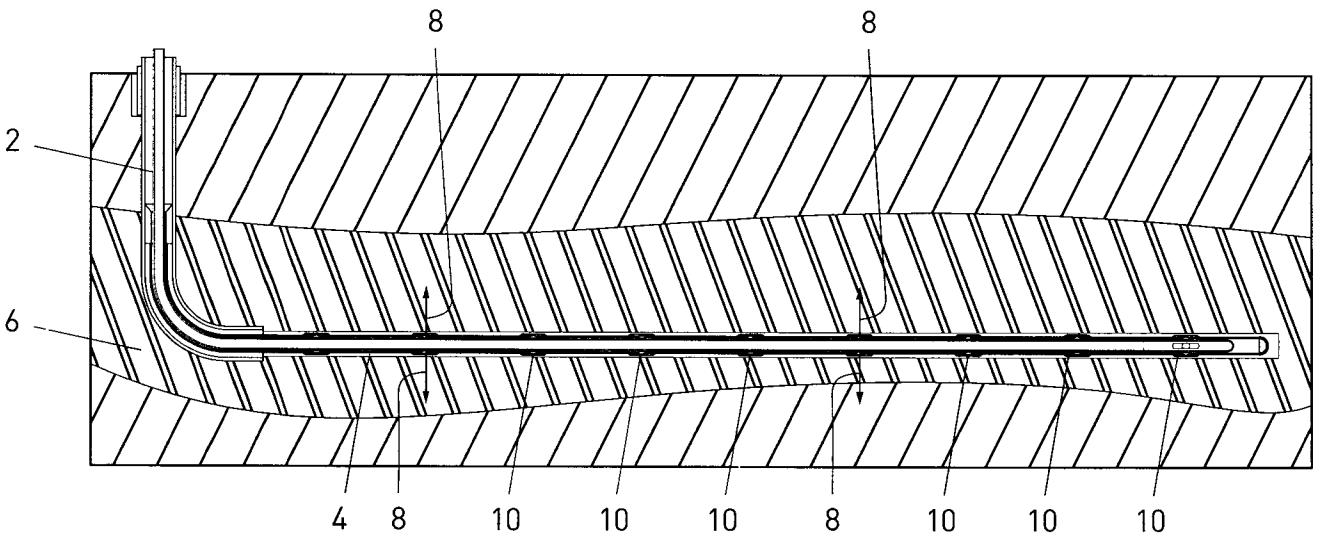
FIG. 1 is a diagram of a side elevation view of a well depicting an embodiment of an apparatus for hydraulic fracing where the formation and well head are visible.

DETAILED DESCRIPTION OF EMBODIMENTS:

Methods and apparatus of pressure activated counting/indexing mechanisms for hydraulic fracturing sleeves and related processes are provided. In some embodiments, the hydraulic fracturing apparatuses for accessing subterranean formations can include a tubular body fluidly connectable in-line with a completion string having an upstream and a downstream, the tubular body can have a housing a flow port in the sidewall. An inner indexing mechanism can be disposed within the housing, where the inner indexing mechanism can include an indexing sleeve, a counting mechanism, and a biasing member. An actuating mechanism can be disposed within the sleeve and, when activated by an appropriately sized actuating member, can be used to move the counting mechanism through a plurality of positions. In some embodiments, the apparatus can also comprise a locking mechanism for preventing the sleeve from shifting prematurely.

In some embodiments, the counting mechanism can comprise an auto-jay mechanism that can include: a circular ring with a pin that can extend radially towards the center of the ring and is axially and rotationally movable to trace along a counting track, such as a series of auto-jay grooves. The inner indexing mechanism can also include a biasing means (for example, a spring) for moving the pin and the ring back and forth through different indexing grooves along the counting track. Apparatus can also include an actuating mechanism for generating force to overcome the biasing member (for example, pressure once an actuating member has landed on the actuating mechanism) and that can rely on the counting mechanism to provide a mechanical signal to either allow the actuating ball, dart, or a plug to pass through or be retained.

An auto-jay groove series can be understood to be a series of grooves configured so that when a pin that engages/traces/meshes the grooves, the pin can move back and forth along the groove to be advanced into a new position and, if the series of grooves are disposed on a tubular body, can rotate around the body along the grooves.

As an overview, in some embodiments, an inner indexing mechanism can be disposed within a tubular housing/body of an apparatus 10, which can comprise a inner indexing sleeve 12 having a counting track 38 (for example, of auto jay grooves 44, 46, and 76, in some embodiments) disposed around its outer diameter. The inner indexing sleeve can be one integral piece, or in some examples, can be multiple components 12, 13 attached together, for example by threading.

The inner indexing mechanism can also include a counting mechanism capable of being moved through a plurality of positions. The counting mechanism can include a ring 32 and pin 34, which can be disposed concentrically around the indexing sleeve 12 in a manner where the pin 34 is configured to engage and trace along the counting track 38. The counting mechanism can also include a counting assembly housing 40 which can separate ring 32 from an upper housing 14. The inner indexing mechanism can further include a biasing member 28, for example a spring, used to bias or urge the counting mechanism to engage and trace the counting track 38.

Apparatus 10 can also include an actuating mechanism configured to overcome the biasing member and move the counting mechanism through a plurality of positions. The actuating mechanism can be activated by an accordingly sized actuating member 50, for example dart, plug, or ball. In some embodiments, the actuating mechanism can include expandable seat members 26, such as dogs, and seat member housing 25. In some embodiments, the dogs can be angled to cradle an actuating member 50 and increase the contact area between the dogs and the actuating member 50. In some embodiments the actuating mechanism can include a split collet structure.

Referring now to FIG. 1, a well 2 is shown from a side elevation view where service/completion string 4 is downhole and proximate formation 6. Fracing fluid 8 can be pumped downhole through service/completion string 4 to fracing apparatus 10. Apparatus 10 can then release pressurised fracing fluid 8 to fracture formation 6. More than one apparatus can be placed along and in line with string 4, creating wellbore zones or segments between each apparatus. In some embodiments, these segments can be fluidly isolated from one another as is known in the art. This process can allow for the targeted fracturing of specific zones.

Figure 2:
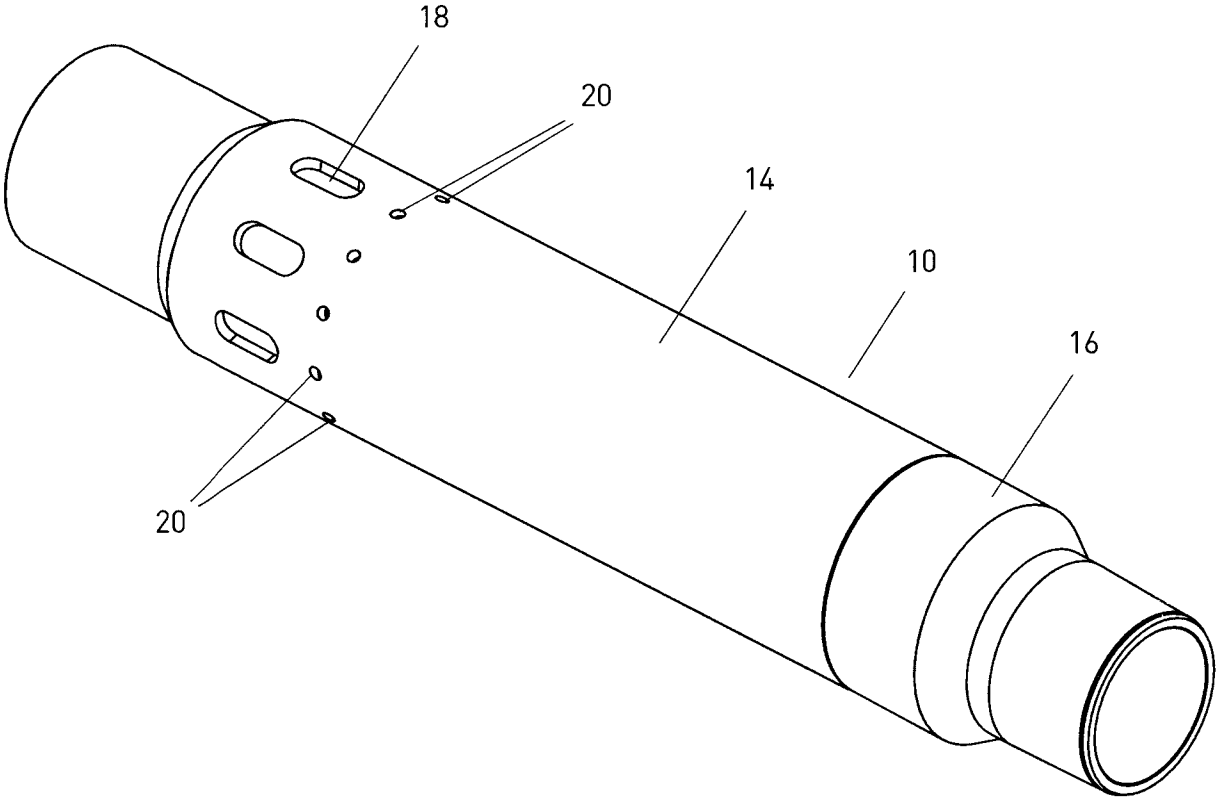
FIG. 2 is a perspective view of an embodiment of a counting completion tool.

Referring now to FIG. 2, apparatus 10 is shown including upper housing 14 and a lower housing 16. Upper and lower as used herein are relative terms and it would be understood by one skilled in the art that the orientation could be inverted without detracting from the function of apparatus. Similarly, top and bottom can be interchanged with terms such as left and right, or upstream and downstream, as required by the context of apparatus 10. Upper housing 14 and lower housing 16 can be generally cylindrical/tubular and can allow fracing fluid 8 to pass into and through apparatus 10. Apparatus 10 can be tubular as to allow a fluid connection with a service/completion sting and allow fracing (or other fluid) to pass into and through apparatus 10.

Apparatus 10 can include one or more flow ports 18 through which fracing fluid 8 can exit service/completion string 4 under pressure. Shear pins 20 can be positioned in shear pin holes 21, in such a manner so as to retain the shifting sleeve 12 to a point until a threshold pressure difference is reached during the time when a ball, plug or dart has seated inside the sleeve 12 on a seat 26. In some embodiments, shear pins 20 can be positioned downstream of flow ports 18.

Figure 3:
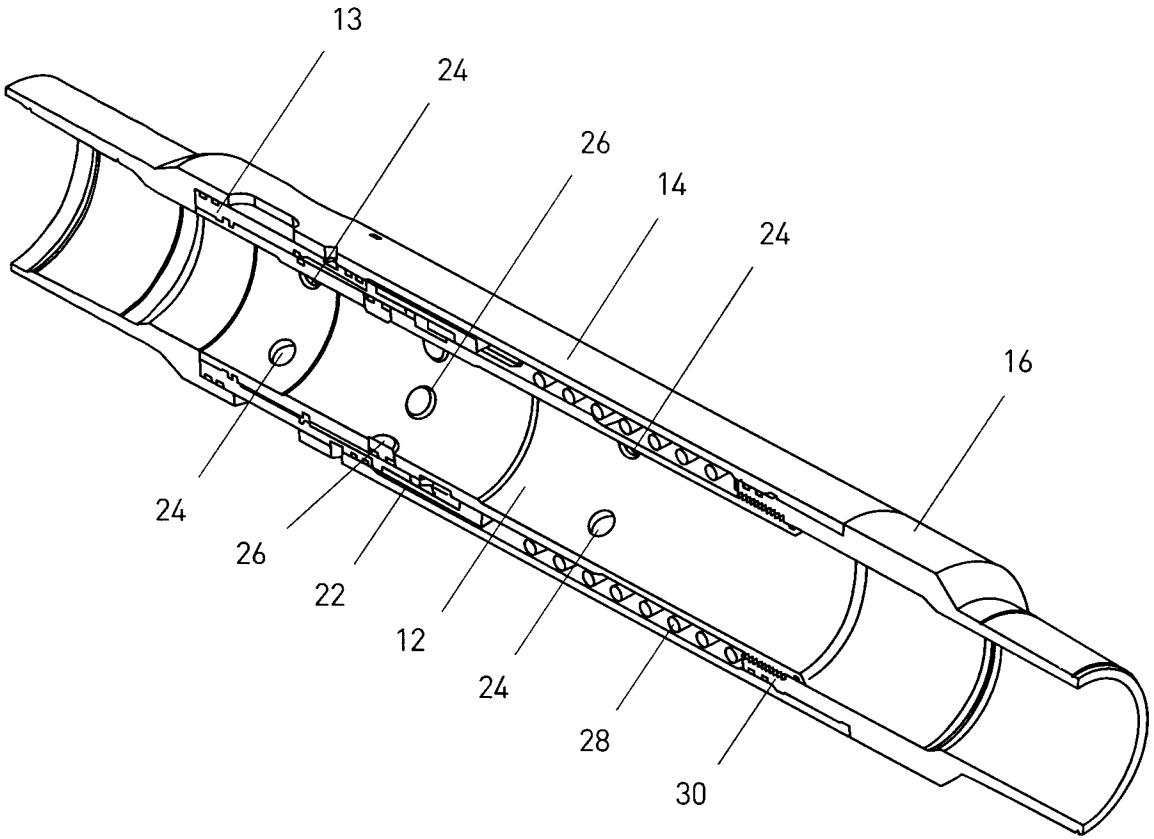
FIG. 3 is cross sectional side view of an embodiment of a counting completion tool.

Referring now to FIG. 3, the interior of an embodiment of apparatus 10 is shown, including upper housing 14 and lower housing 16. Sleeve 12, can also be generally cylindrical/tubular, and can fit within upper housing 14 and lower housing 16. Counting mechanism/assembly 22 can be positioned between sleeve 12 and upper housing 14. Actuation apertures 24 can be positioned around the circumference of sleeve 12, in some embodiments, both upstream and downstream of expandable seat members 26. Actuation apertures 24 can be covered by debris barriers 61 to allow the passage of fluid, but preventing the flow of debris between components. Biasing member 28, for example a spring, can be positioned downstream of counting mechanism/assembly 22 and hold-open assembly 30 can be positioned downstream of biasing member 28. In some embodiments, biasing member can be a compressed fluid, such as a compressed gas, and/or a compressed liquid, in the presence or absence of a spring.

Figure 4:
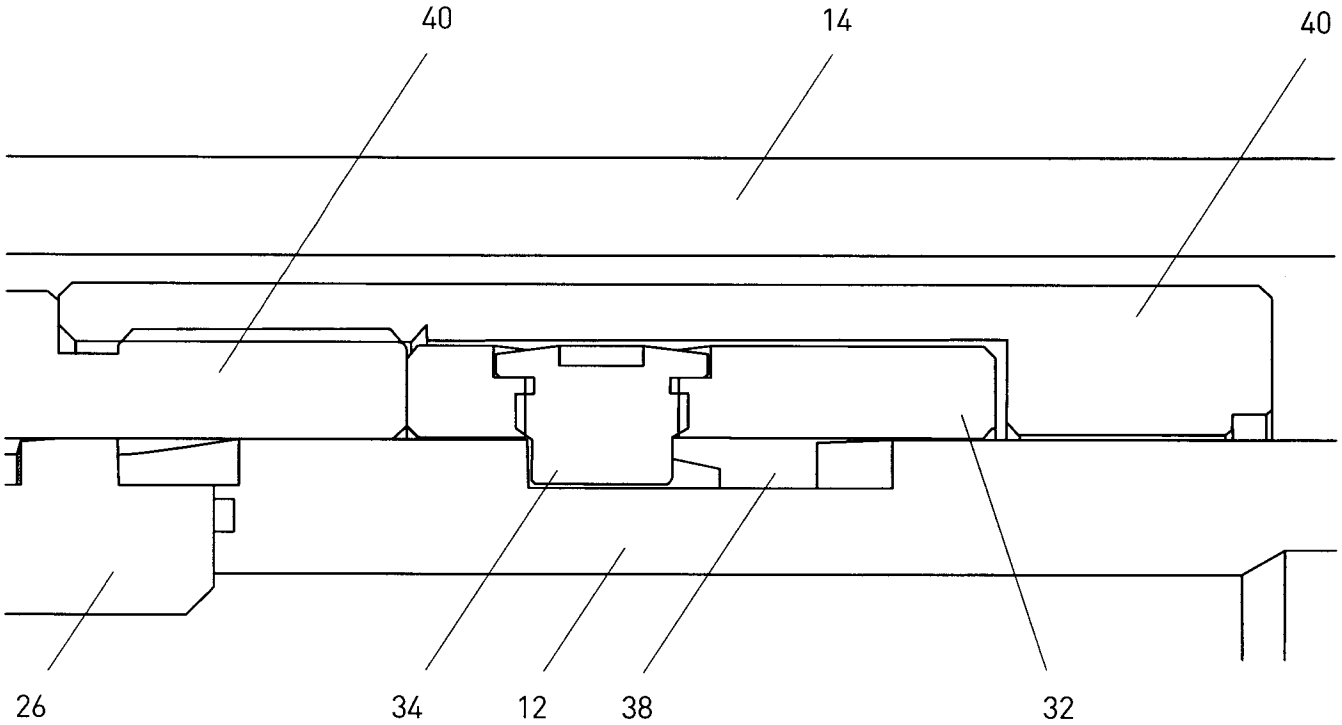
FIG. 4 is a cross sectional, close-up, side view of an embodiment of a counting assembly.
Figure 5:
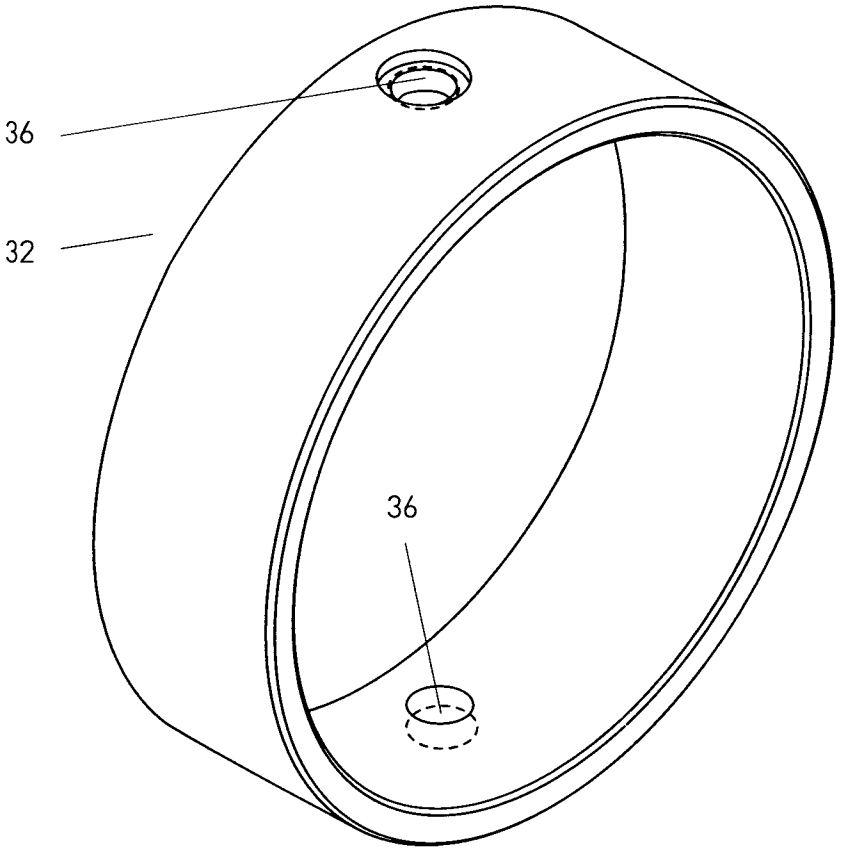
FIG. 5 is a perspective view of an embodiment of a counting ring used in an embodiment of a counting assembly.

Referring to FIGS. 4 and 5, a cross section and perspective view, respectively, of counting mechanism/assembly 22 components are shown. Ring 32 can positioned around sleeve 12. Pin 34 can pass through ring 32 via pin aperture 36, as shown in FIG. 5, and can rest on, and is moveable relative to, counting track 38. Counting assembly housing 40 can separate ring 32 from upper housing 14.

Figure 6:
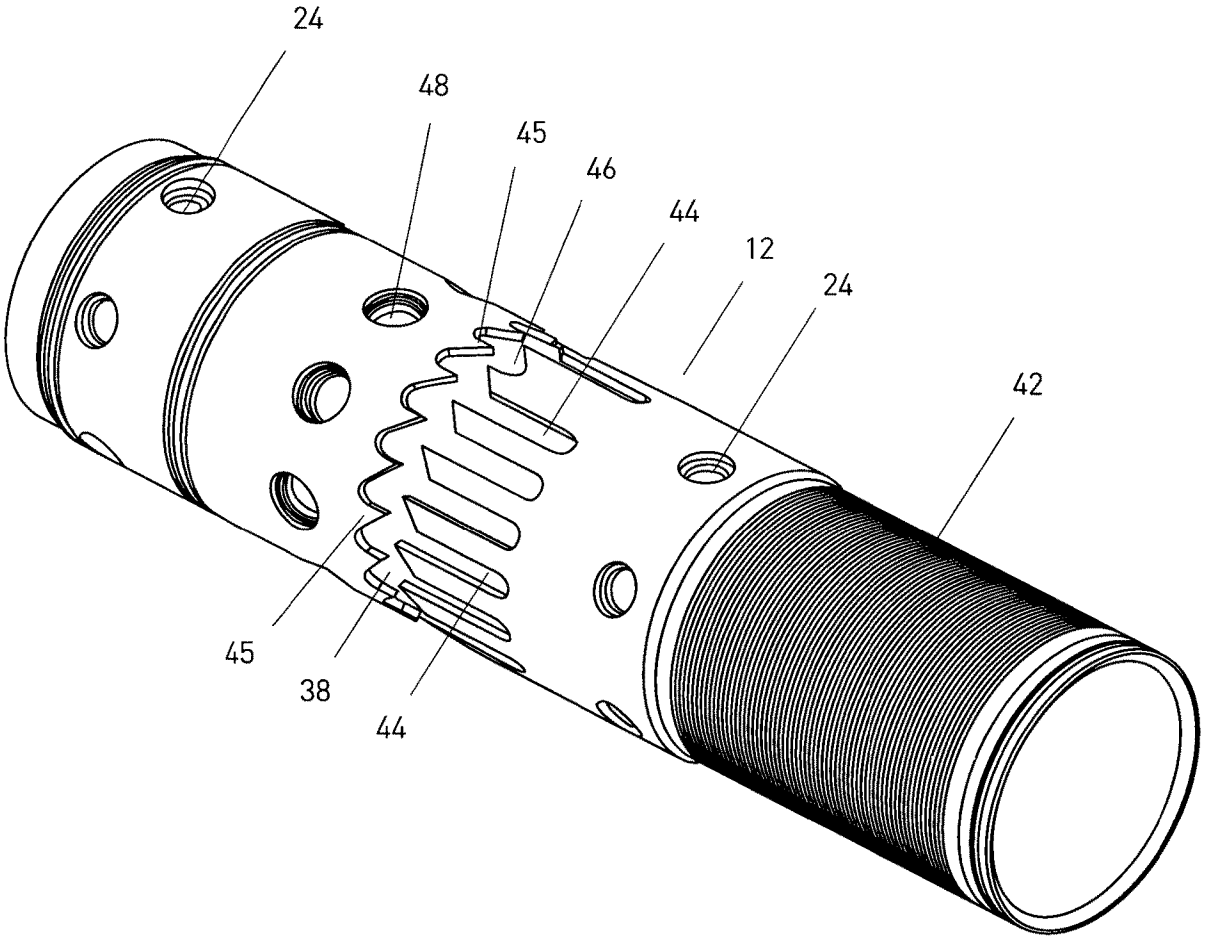
FIG. 6 is a perspective view of an embodiment of a sleeve used in an embodiment of a counting completion tool.

Referring to FIG. 6, a perspective view of sleeve 12 is shown. Locking ratchet profile 42 can be downstream on the exterior of sleeve 12. Counting track 38 can be inlaid in sleeve 12 and can include a plurality of long grooves 44 positioned relatively parallel to each other and transverse to the circumference of sleeve 12. A short groove 46 can positioned between two long grooves 44, and/or at the end of counting track 38. Between and opposite each long groove can be a tooth 45 shaped and aligned to prevent pin 34 from reversing direction as it moves from one groove to an adjacent groove. Such a configuration of counting track 38 can be described as a series of axial auto jay grooves. Expandable seat apertures 48 are positioned to allow expandable seat members 26 to pass through.

Figure 7A:
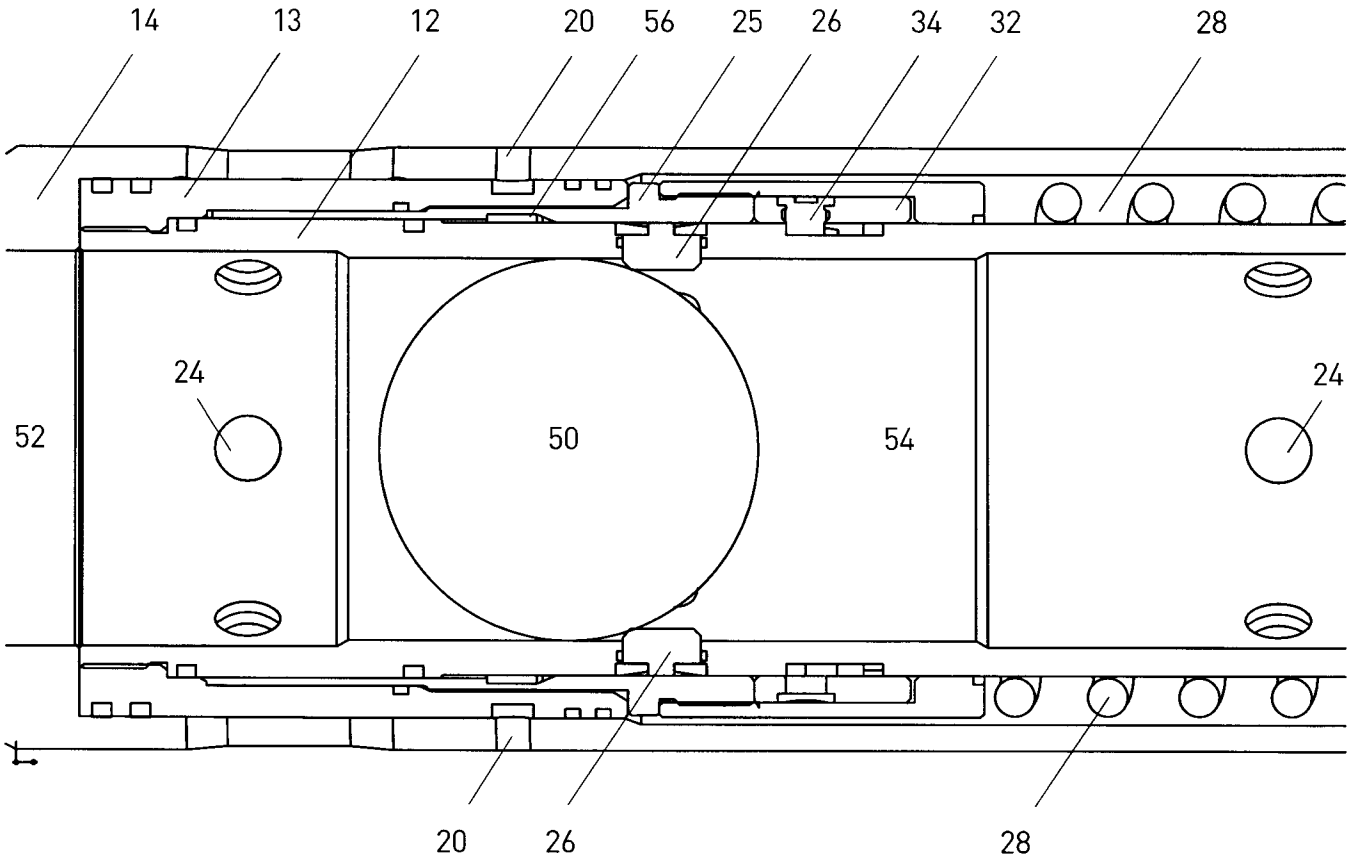
FIGS. 7A, 7B, 7C, 7D and 7E show cross sectional embodiments of a counting completion tool in use.
Figure 7B:
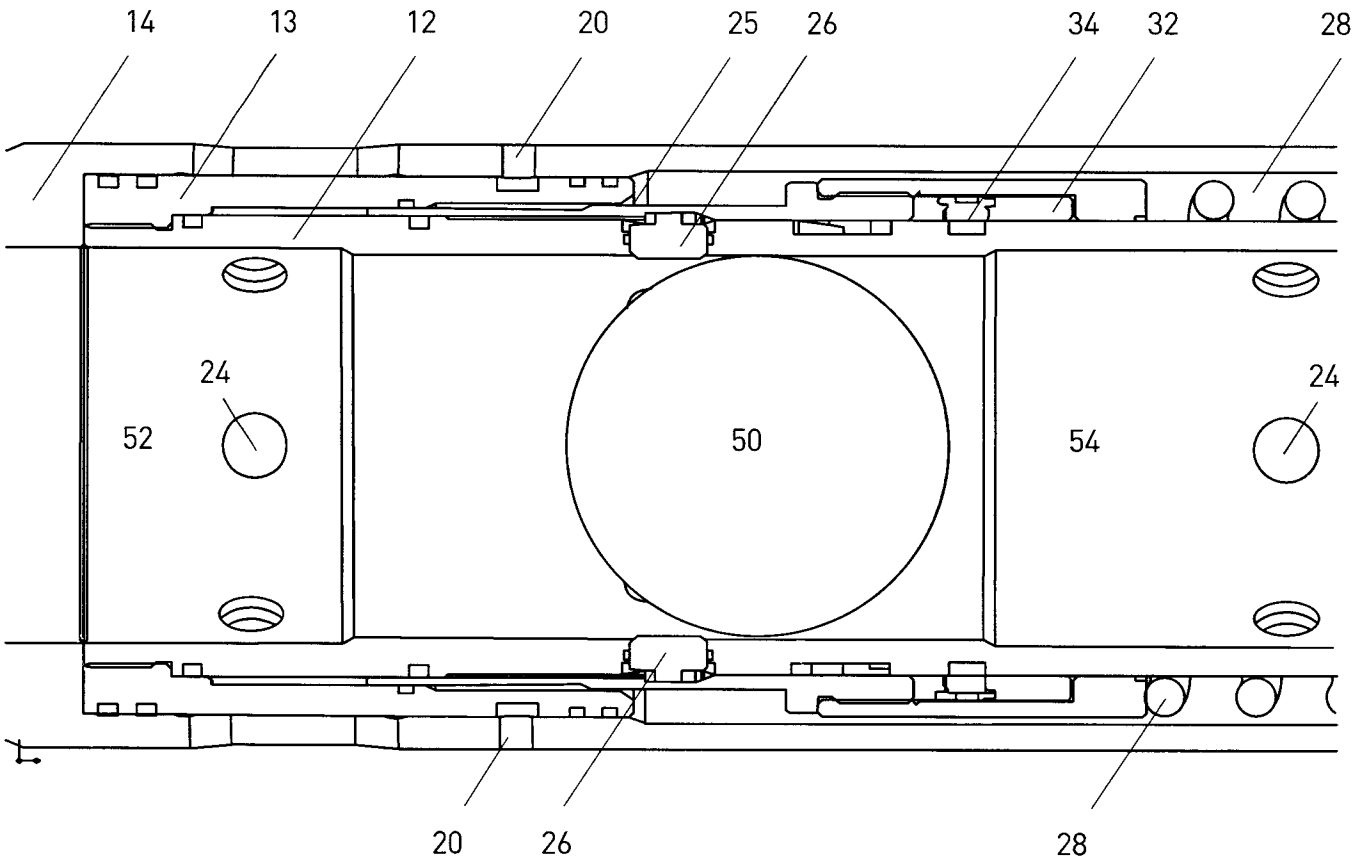

FIGS. 7A through 7E show the process by which an embodiment of fracing apparatus 10 can work in operation. Referring to FIG. 7A, actuating member 50 has been released through service/completion string 4, and has come to rest against expandable seat members 26, creating a high pressure zone 52 upstream of actuating member 50 as fracing fluid 8 is blocked, and a low pressure zone 54 downstream.

Sleeve 12 can be held in place by shear pins 20, and/or a locking mechanism 64 as discussed further herein. In some embodiments, sleeve 12 can be threaded into upper sleeve collar 13 that can be directly held in place by shear pins 20. In some embodiments, sleeve 12 can integral with upper sleeve collar 13. In some embodiments, sleeve 12 and upper sleeve collar 13 can be made as separate components. When actuating member 50 lands, the high pressure fluid above the actuating member 50 is able to create a force (through holes 24 upstream of actuating member 50) to move the auto-jay counting mechanism seat housing 25 and relief 56 down towards a low pressure area. During the forward motion, the auto-jay ring 32 and pin 34 can follow the counting track 38 in sleeve 12. If the track is long 44, seat housing 25 can travel far enough to allow the relief 56 to align with expandable seat members 26 as shown on FIG. 7B. Once aligned, members 26 can expand out and allow the actuating member 50 to pass.

Figure 7C:
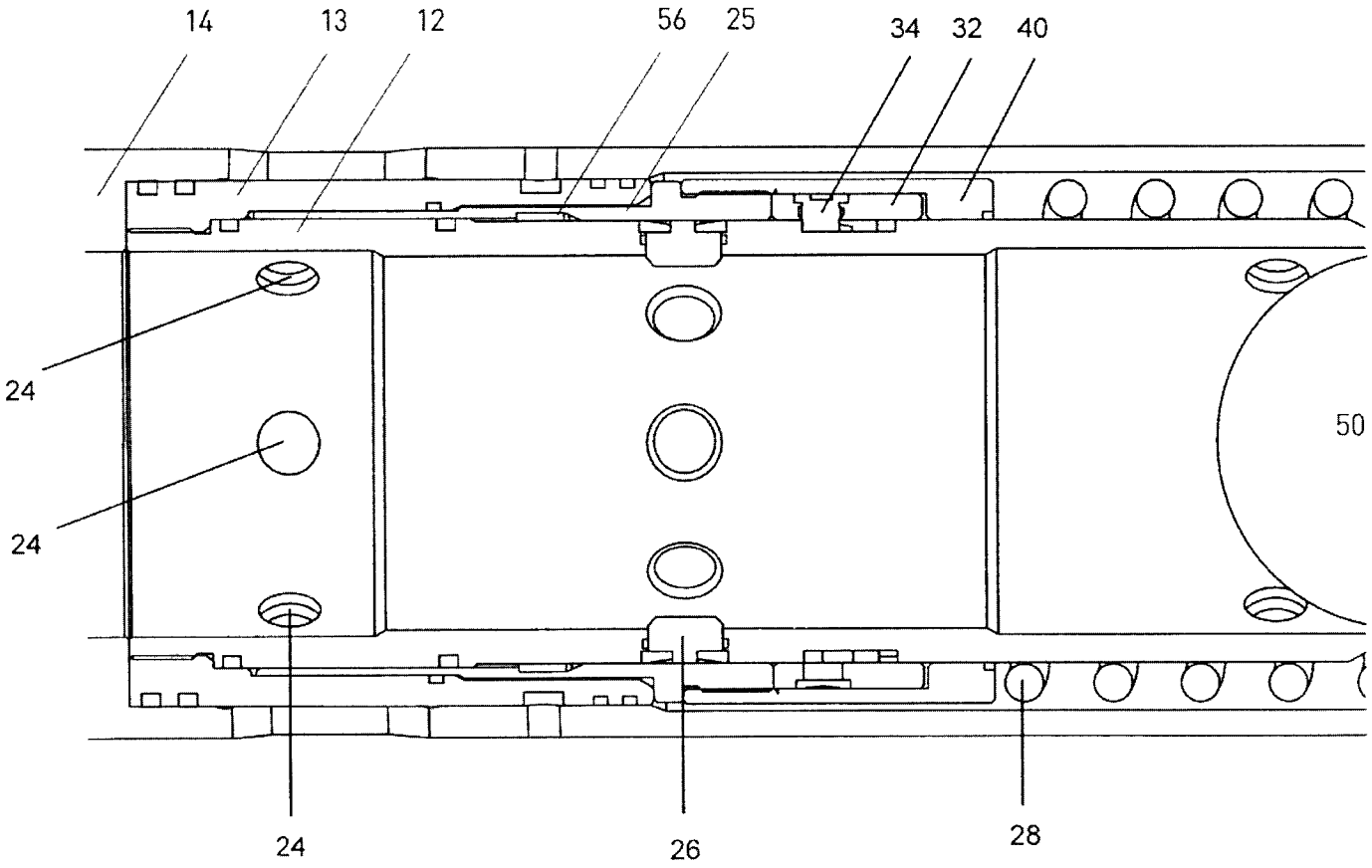

Referring to FIG. 7C, as actuating member 50 exits apparatus 10, the pressure within apparatus 10 equalizes through apertures 24, allowing biasing member 28 to reset. Pin 34 can then slide out of long groove 44 and is directed by teeth 45, which can cause auto-jay ring 32 to rotate within counting assembly housing 40 and align pin 34 with the adjacent groove. Auto-jay ring 32 can then be back in a position that collapses the expandable seat 26.

Figure 7D:
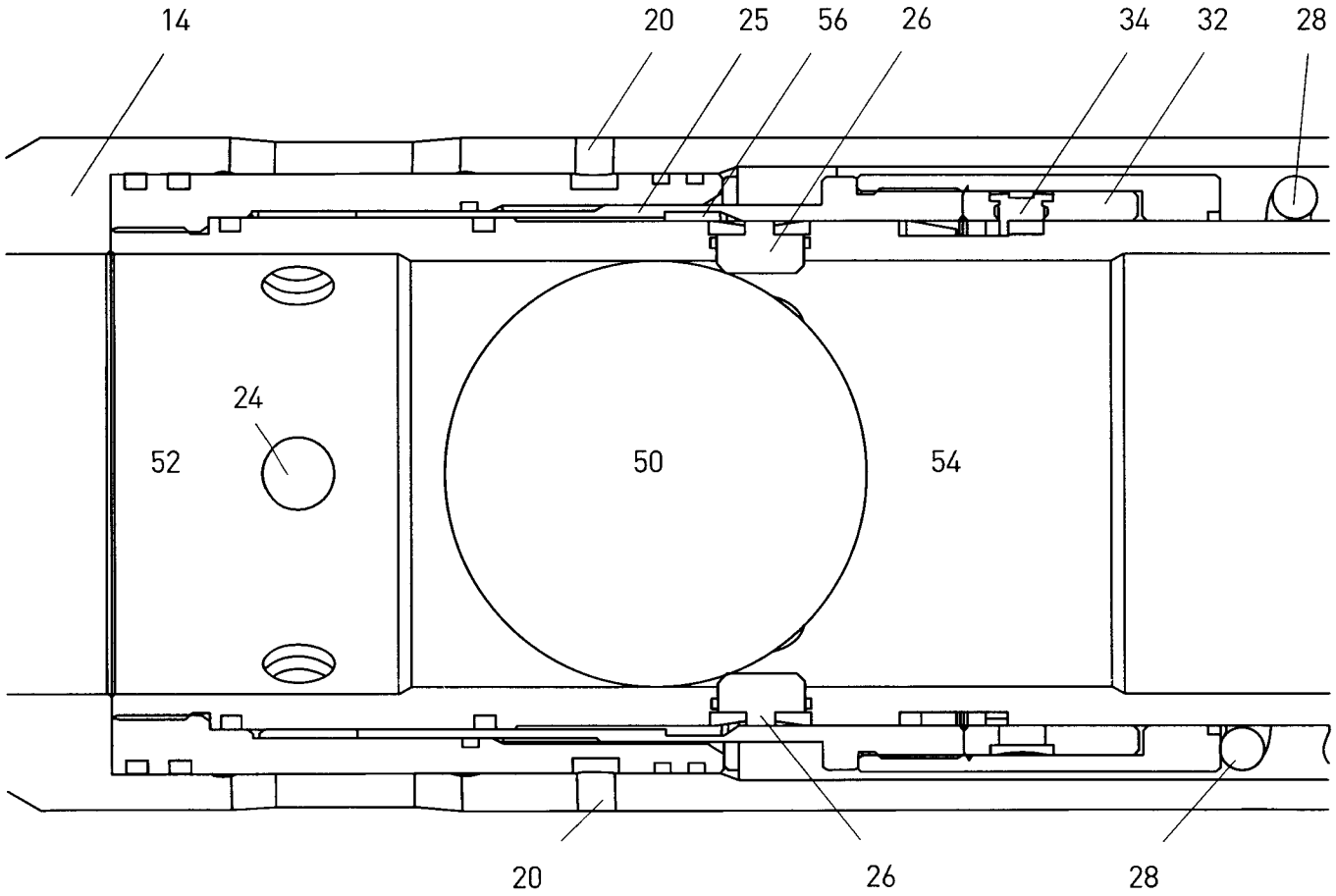
Figure 7E:
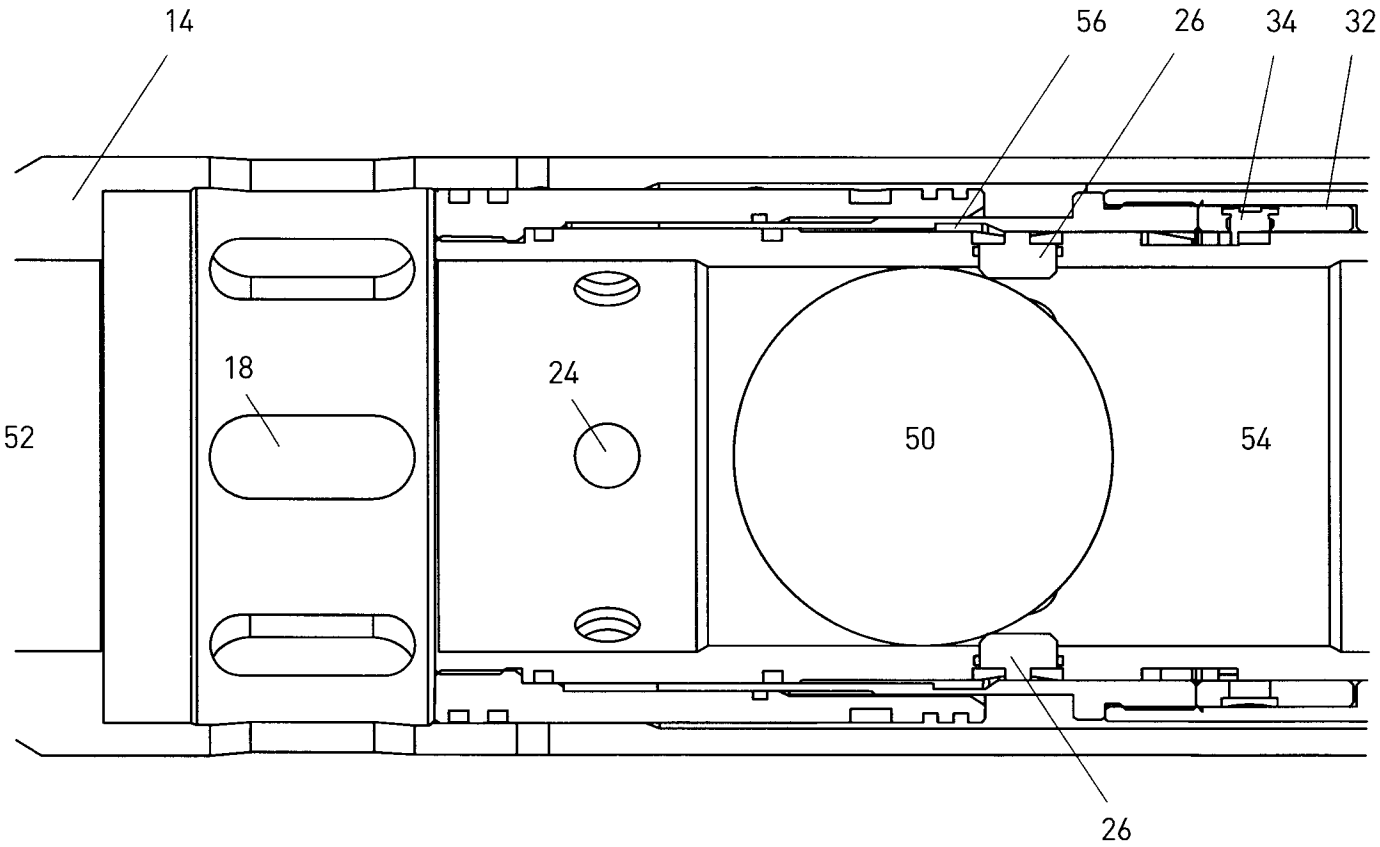
Figure 8:
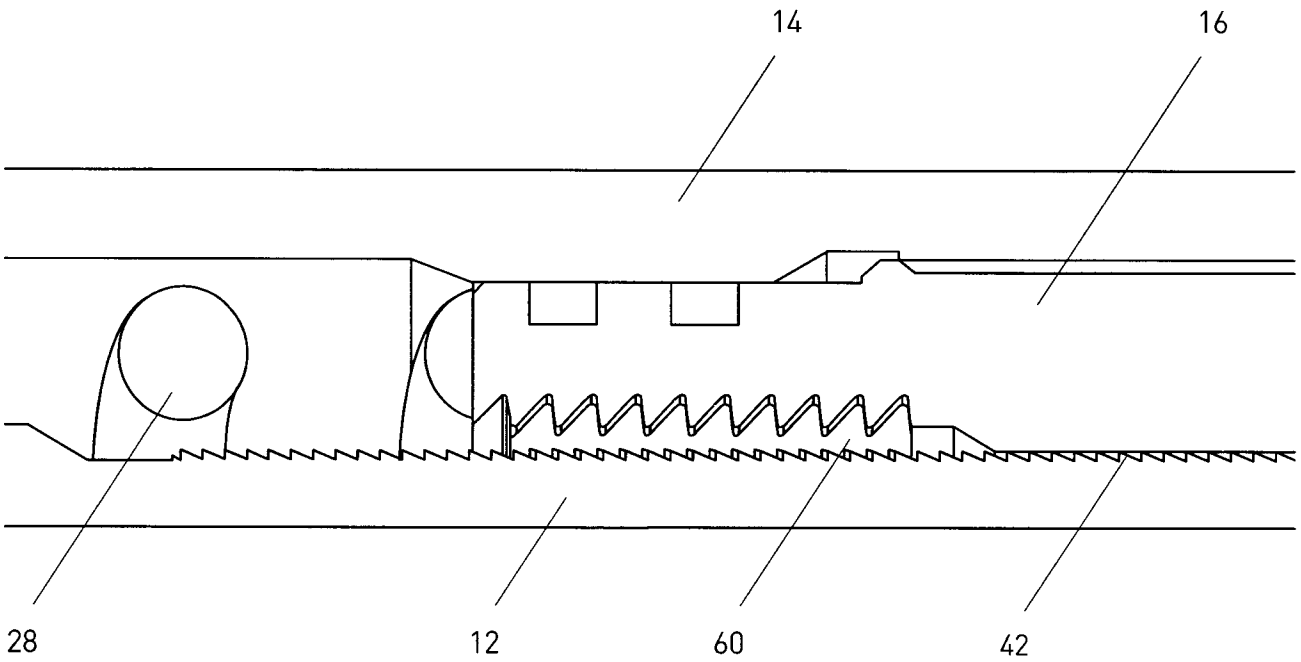
FIG. 8 is a cross sectional, close-up, side view of an embodiment of a hold-open assembly.

Referring to FIG. 7D, a subsequent actuating member 50 has entered fracing apparatus 10, however in this example, pin 34 is aligned with short groove 46. This prevents release relief 56 from aligning with expandable seat members 26 and therefore, expandable seat members do not allow actuating member 50 to pass. Referring to FIG. 7E, as actuating member 50 is unable to pass, pressure increases until shear pins 20 break under pressure. As shear pins 20 prevent sleeve 12 from moving downstream, once shear pins 20 break, sleeve 12 moves downstream, exposing flow ports 18 that were previously blocked by sleeve 12, and allowing the fracing fluid 8 to exit the fracing apparatus. Referring to FIG. 8, as sleeve 12 moves downstream, ratchet ring 60 can meet with locking ratchet profile 42 and can prevent sleeve 12 from moving upstream, thus maintaining flow ports 18 in an open position.

Therefore by aligning the short grooves 46 to correspond with the order in which each fracing apparatus 10 along the service/completion string 4 will operate, a user can determine the order in which the fracing apparatus 10 will release fracing fluid 8 by using actuating members 50 of a standard or uniform size. For example, the user could use eighteen of apparatus 10, each having a counter set in different positions from one to eighteen respectively. Position one being a position in which counting pin 34 can be aligned with a short groove 46 of counting track 38 and position eighteen indicating a number of grooves that the counting mechanism 22 has to advance the counting pin 34 in order to reach a short groove 46 on the indexing sleeve 12. Each of the independently set counting apparatuses can then be installed in a well 2, furthest downhole apparatus being on counter position one and closest uphole counter being on position eighteen. An actuating member 50 can then be pumped to count down all of the apparatuses in well 2 by a count of one in the following order: apparatus with counter set to eighteen counts down to seventeen, apparatus with counter set to seventeen counts down to sixteen, and so forth until the actuating member 50 reaches an apparatus with a counter 22 set to one; at which point the counter 22 will not allow the actuation member 50 to pass and would cause the apparatus to open and allow communication with the wellbore. The process of pumping in an actuator 50 is repeated to open each of the eighteen apparatuses in order from the apparatus at a toe (furthest downhole) of well 2 to the apparatus at the heal (closest uphole) of well 2.

In operation, apparatus 10 can be used in a wellbore operation wherein apparatus 10 can be positioned in a well 2 with housing 14, 16 in a selected position. Force can be applied to counting mechanism 25, 32 of apparatus 10 to drive mechanism 25, 32 through a plurality of positions. The plurality of positions can include first and second positions, active and passive positions, open and closed positions, and/or equivalents thereof.

Force, for example a pressure increase, can be applied to move counting mechanism 22, 25, 32 around sleeve 12 along counting track 38 from a first to second position. As counting mechanism 22, 25, 32 is actuated, it can rotate slightly each time, causing it to count as it moves from groove to groove. Every time an actuator 50 (for example a ball, dart or a plug) lands in the expanding seat 26, the auto jay counting mechanism 22, 25, 32 can be engaged, sending a mechanical signal back to expanding seat 26 as to which position counting pin 34 is at. If pin 34 is at a long groove 44, actuating member 50 can be allowed to pass (while still rotating pin 34 to a next position). If pin 34 is in a short groove 46, seat member 26 is not given a mechanical signal to expand and actuating member 50 is not allowed to pass; this can enable an operator to increase pressure upstream of actuating member 50 to a threshold level that can shift sleeve 12 assembly, opening flow ports 18.

Further actuators can be pumped downhole through apparatus 10 in order to cycle the indexing mechanism to advance the auto-jay pin 34 one groove at a time from passive (long grooves) to an active (short groove) positions. An active position is that in which expandable seat 26 will not be allowed to expand anymore, therefore trapping the actuator 50, allowing pressure to build, shifting sleeve 12, and opening ports 18 such that fluid from string 4 is released to access and fracture formation 6.

Figure 9:
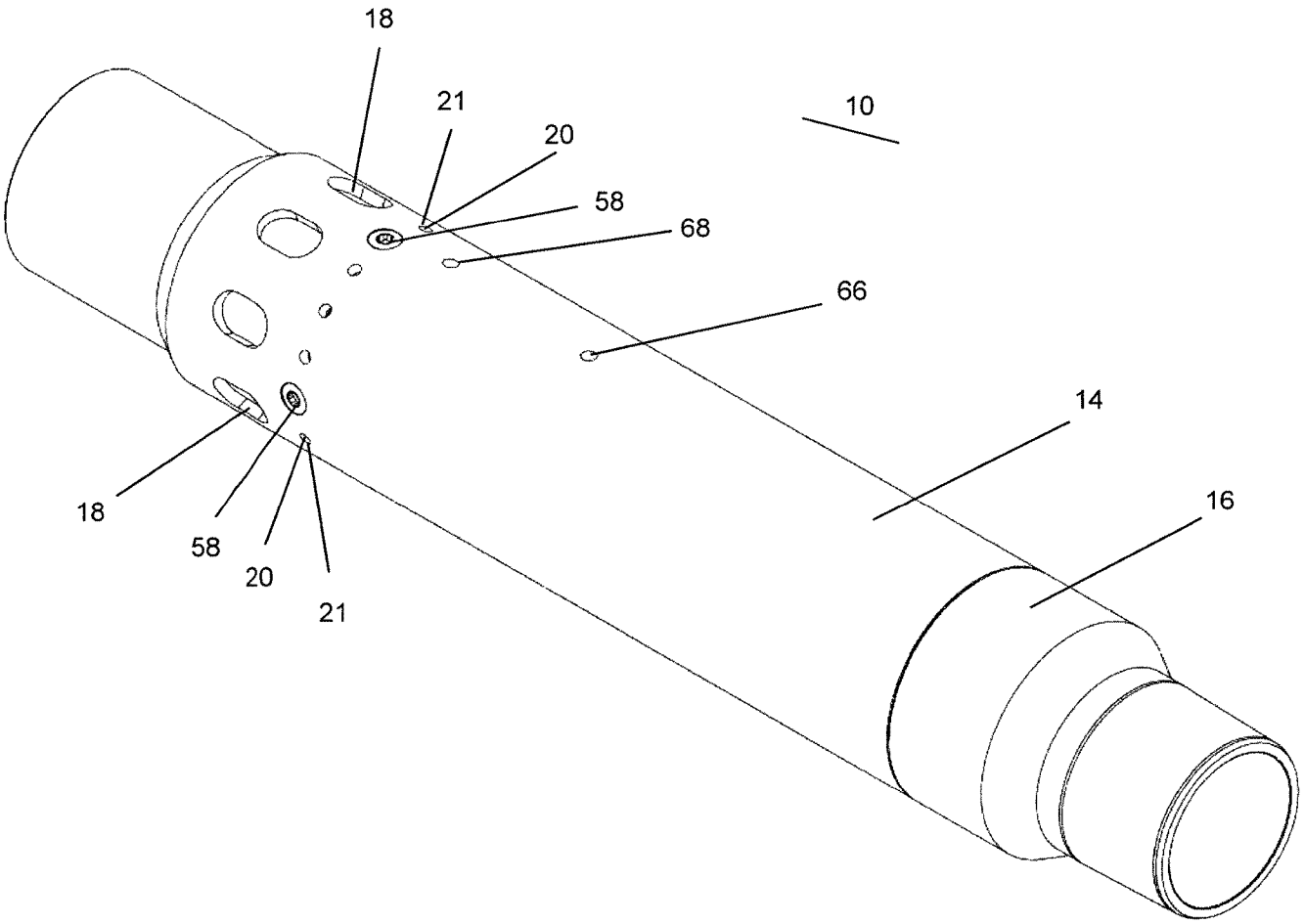
FIG. 9 is a perspective view of an embodiment of a counting completion tool.
Figure 10:
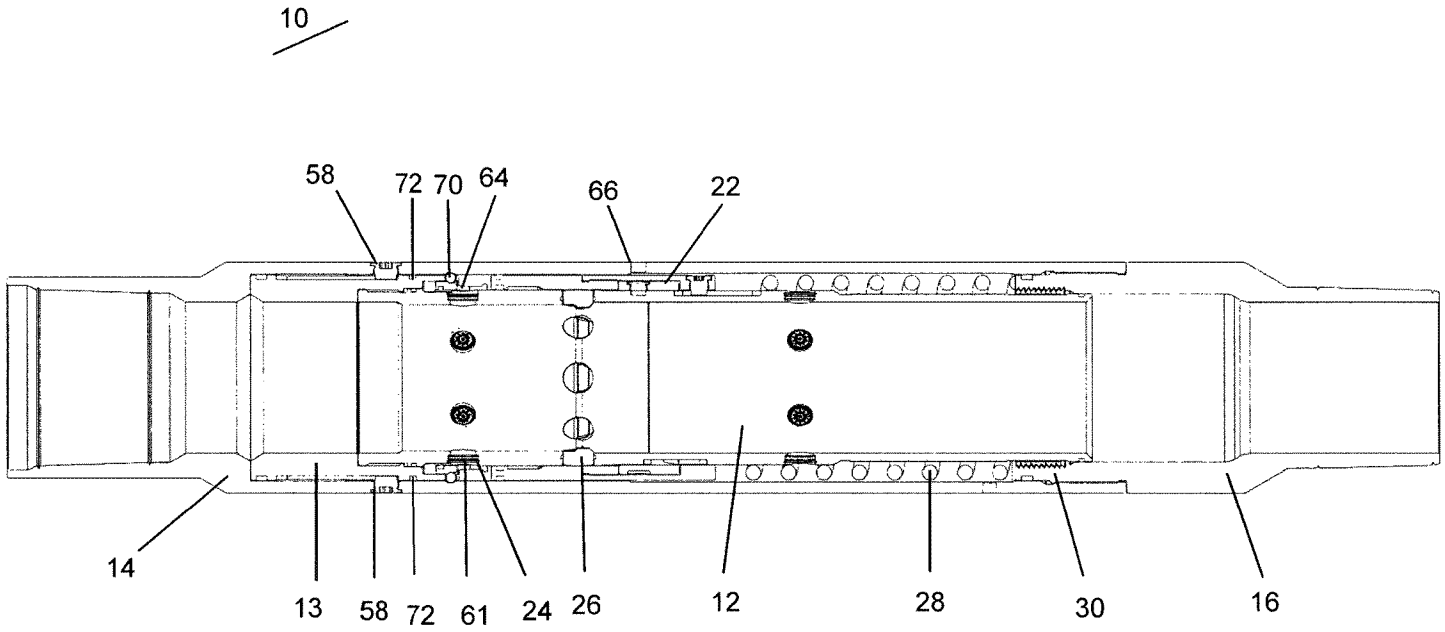
FIG. 10 is cross sectional side view of an embodiment of a counting completion tool.
Figure 17:
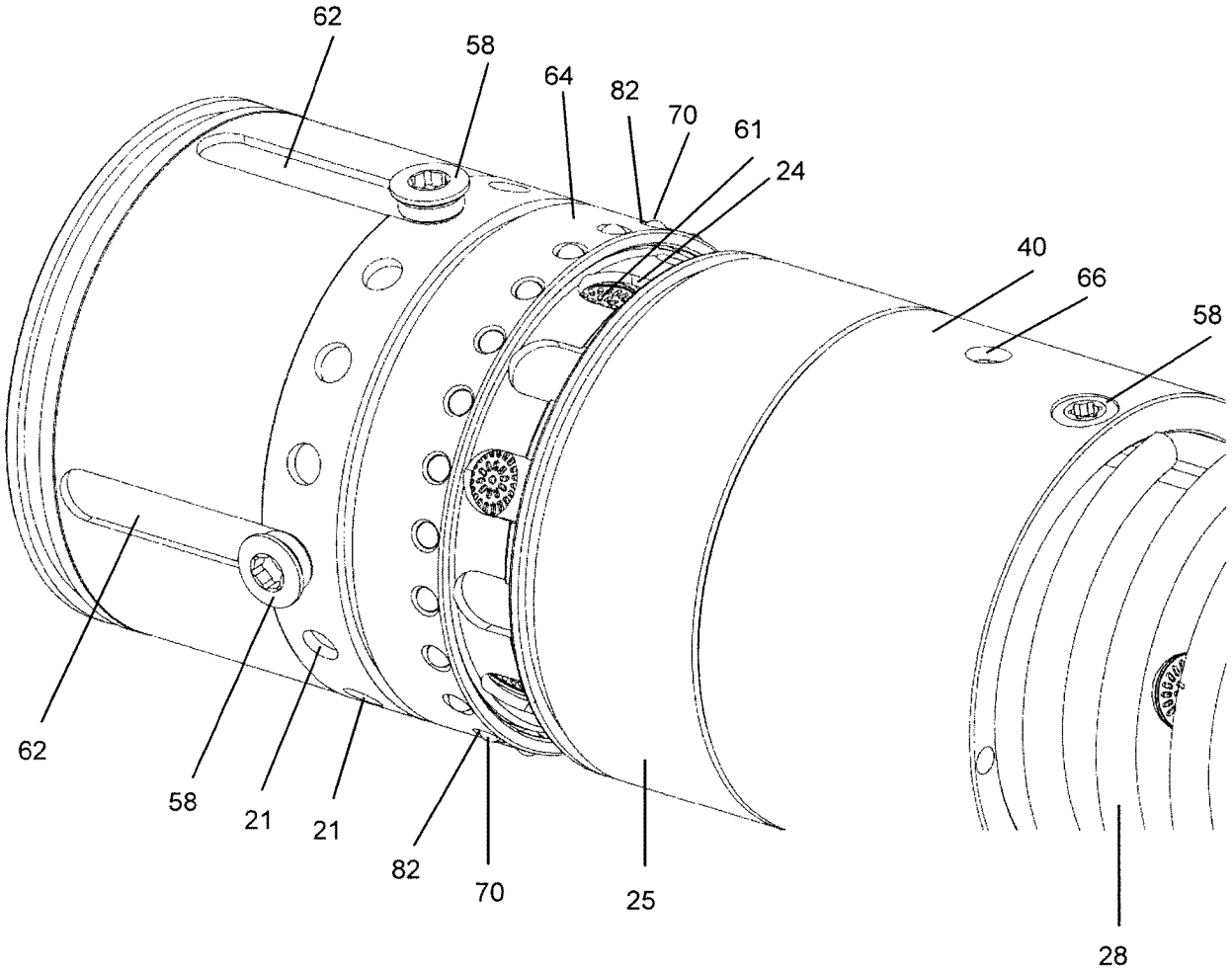
FIG. 17 is a cut-away, perspective view of an embodiment of a counting completion tool with the upper and lower housing removed.

In some embodiments, torque screws 58 can be used to restrict inner indexing mechanism within apparatus 10 in a manner that allows it to slide back and forth (for example, upstream and downstream) in a corresponding torque screw groove 62, but not rotate (see FIG. 9, FIG. 10, and FIG. 17). In some applications, following use of apparatus 10, operators may desire to mill or drill the internal components out from apparatus 10. If not rotationally fixed to the outer housing, for example by torque screw 58 and torque screw groove 62, internal components may simply spin/rotate in response to the rotational milling/drilling and they will not be broken down efficiently.

An example of an embodiment of a fracing apparatus 10 can allow for an inner diameter (ID) as close to the casing inner diameter as possible. It is important for efficiency to allow for a large and consistent inner diameter. Prior art systems relay on smaller and smaller inner diameters in order to specifically target opening certain tools in target zones by using varying sized actuating members (ex. ball, dart). As a result, the more prior art tools that are used along a string, the smaller the functional inner diameter of the string becomes along several stages, thereby decreasing the overall efficiency of the system.

In operation, several embodiments of apparatus 10 can be used along service/completion string 4 to create multiple zones within a well. Indexing sleeves and counting mechanisms can utilize a certain number of inactive grooves, for example eighteen, although it would be understood that any suitable number could be used. In this example, eighteen full inner diameter zones can be created that can be actuated with the largest corresponding actuating member. In situations where more zones/stages are desired and ID restriction is tolerable (and/or the actuating mechanism can be drilled/milled out), multiple sets of apparatuses 10 using varying sized actuating members 50 can be used.

As an example only, a first set of eighteen apparatuses 10 can be positioned towards the bottom of well 2 and have an ID of 3.500" (activated with a larger, 3.625" ball) and another set of eighteen apparatuses 10 with an ID of 3.625" (activated with a larger 3.750" ball) can be positioned uphole/upstream of the first eighteen apparatuses 10. This arrangement would allow for thirty-six stages. As currently known in the art, there is a limit of approximately twenty-four stages with ⅛" increment in ball size. Using the apparatuses 10 herein each of those twenty-four stages of varying actuating member sizes can include a set of eighteen full apparatuses 10 for a total of 432 stages. It would be understood that varying the number of inactive grooves and the number of available actuating member sizes, the total number of available stages will also vary.

Some embodiments can also include an optional sleeve locking mechanism 64 in order to prevent sleeve 12 from shifting in response to unexpected or undesired force on the actuation mechanism. Locking mechanism 64 can be referred to as an anti-preset ring. In some cases, the pressure can arise from momentum of actuating member 50, rather than a build-up of pressure, causing shear pins 20 to shear. Locking mechanism can prevent sleeve 12 from shifting unless counting mechanism/assembly is in the desired position/count.

Referring now to FIG. 9 and FIG. 10, an embodiment of apparatus 10 is shown including upper housing 14, a lower housing 16, flow ports 18, shear pins 20 in shear pin holes 21, and torque screws 58. In some embodiments, a viewing window 66 can be used to allow a user to look through to check the position (number) on counting assembly/mechanism 22 to see/confirm what counting cycle the tool 10 is in. In some embodiments, a bearing feeding port 68 can be used to allow a user to load bearings 70, for example ball bearings, into locking mechanism 64. Actuation apertures 24 can be covered by debris barriers 61 to allow the passage of fluid, but preventing the flow of debris between components. Biasing member 28 can be positioned downstream of counting mechanism/assembly 22 and hold-open assembly 30 can be positioned downstream of biasing member 28. Seals 72 can be used to divide high pressure zones from low pressure zones within apparatus 10.

Figure 11:
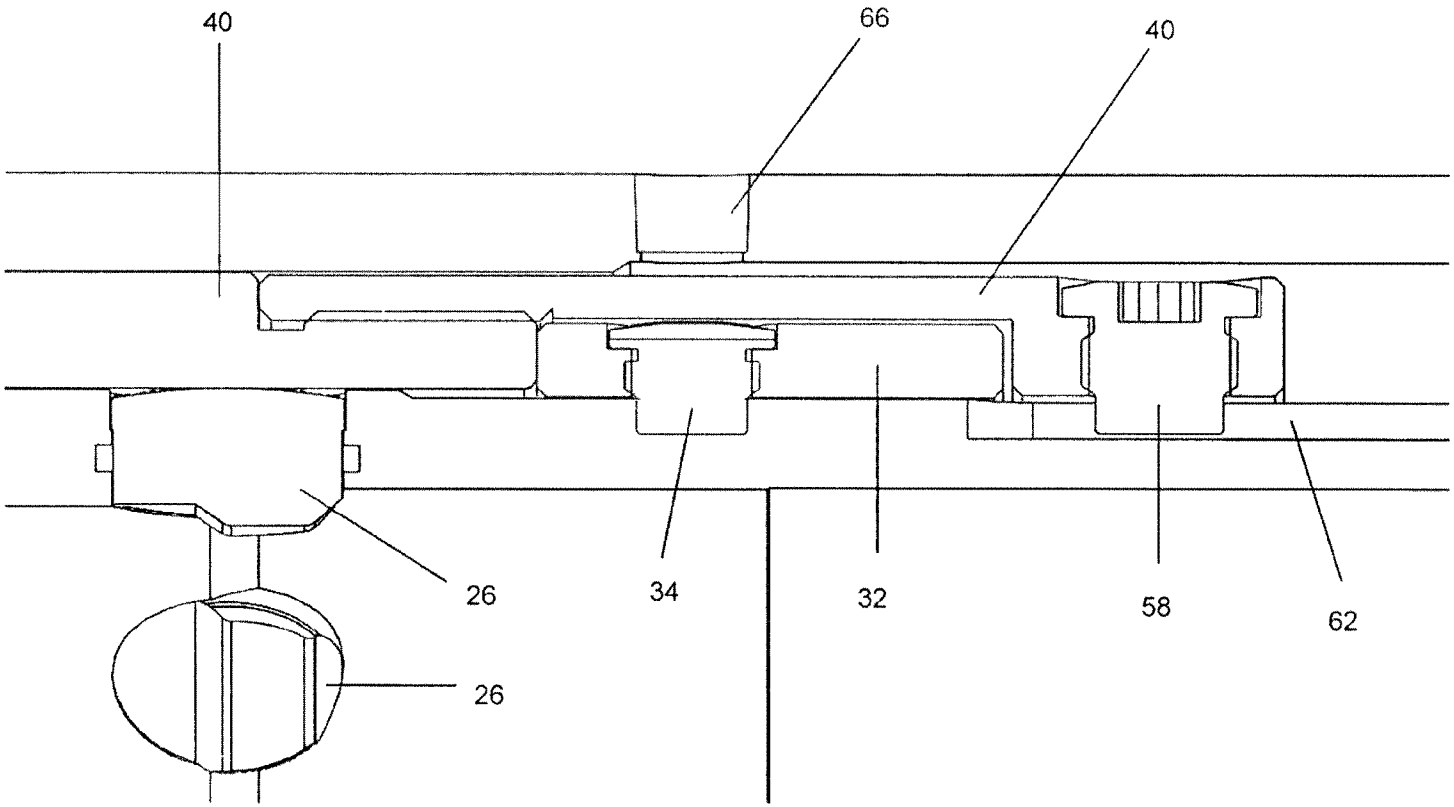
FIG. 11 is a cross sectional, close-up, side view of an embodiment of a counting assembly.
Figure 12:
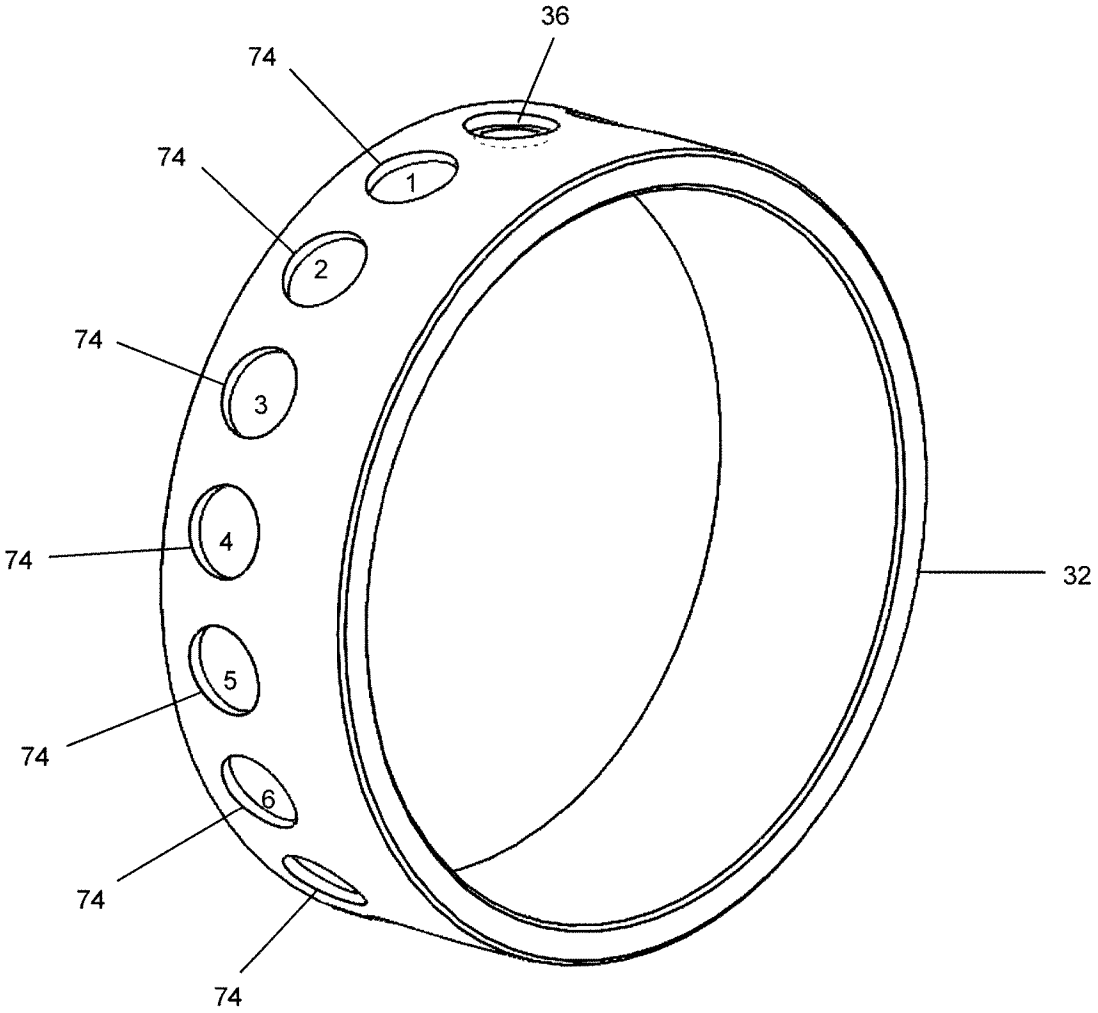
FIG. 12 is a perspective view of an embodiment of a counting ring used in an embodiment of a counting assembly.

Referring to FIG. 11 and FIG. 12, a close-up cross section and perspective view, respectively, of embodiments of counting mechanism/assembly 22 components are shown. Ring 32 can positioned around sleeve 12. Pin 34 can pass through ring 32 via pin aperture 36, as shown in FIG. 12, and can rest on, and is moveable relative to, counting track 38. Counting assembly housing 40 can separate ring 32 from upper housing 14. In some embodiments, a torque screw 58 can be used as a guide pin to allow counting assembly/mechanism 22 to move upstream/downstream in torque screw groove 62, but preventing counting assembly/mechanism 22 from rotating. Ring 32 and pin 34 can remain free to rotate relative to sleeve 12 and counting assembly/mechanism 22. Numbered indents 74 can be disposed around ring 32 and can be viewed by operator through viewing window 66 to reflect a counting position of counting mechanism/assembly 22.

Figure 13:
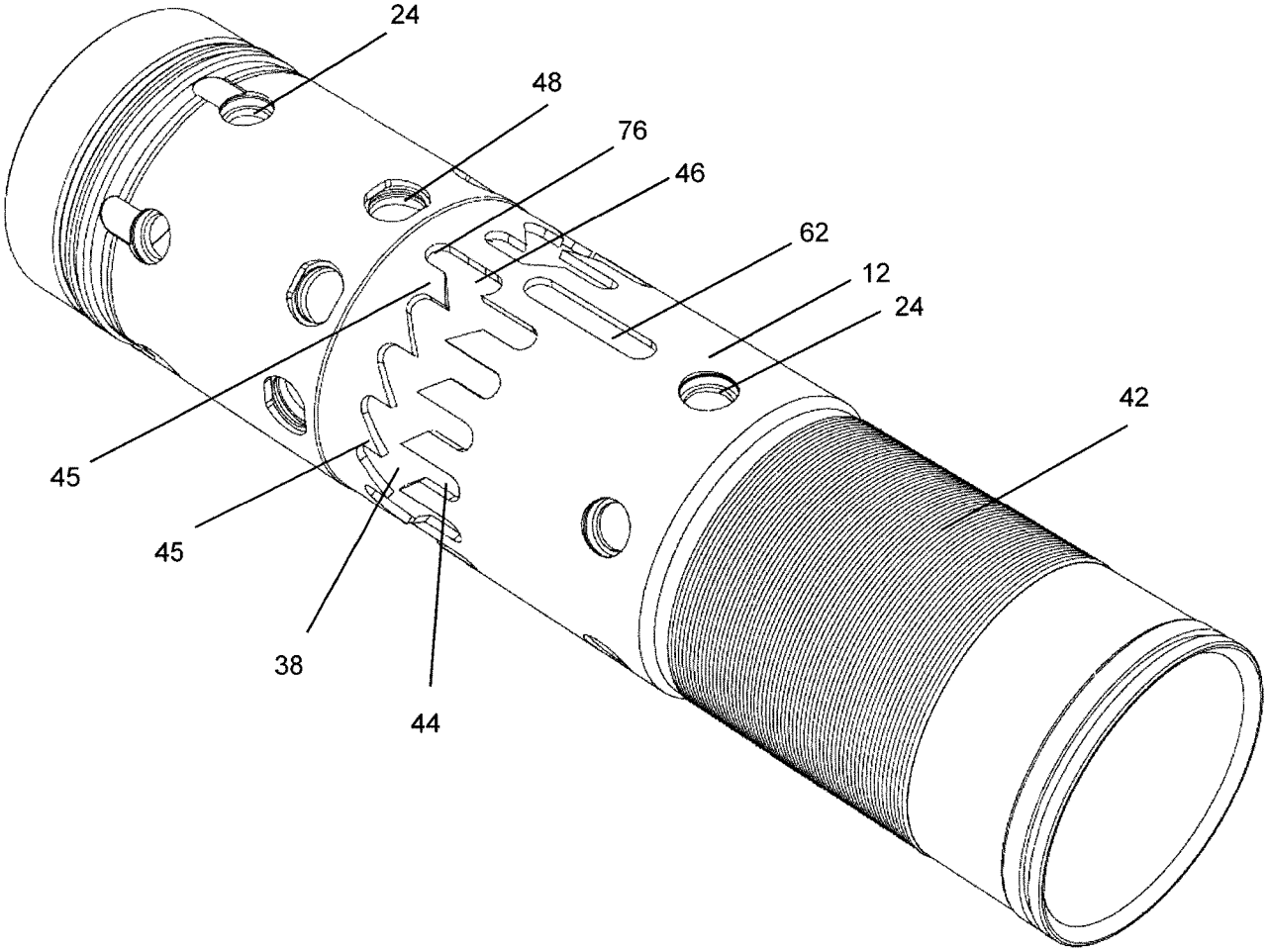
FIG. 13 is a perspective view of an embodiment of a sleeve used in an embodiment of a counting completion tool.

Referring to FIG. 13, a perspective view of an embodiment of sleeve 12 with ratchet profile 42 and counting track 38 is shown. In some embodiments, a backswing groove 76 can be included in counting track 38. Upon the last upstream movement of sleeve 12, prior to the activation of apparatus 10 (engagement of short groove 46), tooth 45 can direct pin 34 into backswing groove 76 which can allow counting mechanism/assembly 22 to move further upstream than any other position along counting track 38. Such upstream movement can allow for the disengagement of locking mechanism 64 and accordingly, the ability for shear pins 20 to shear under pressure and allowing sleeve 12 to shift and open flow ports 18.

Figure 14A:
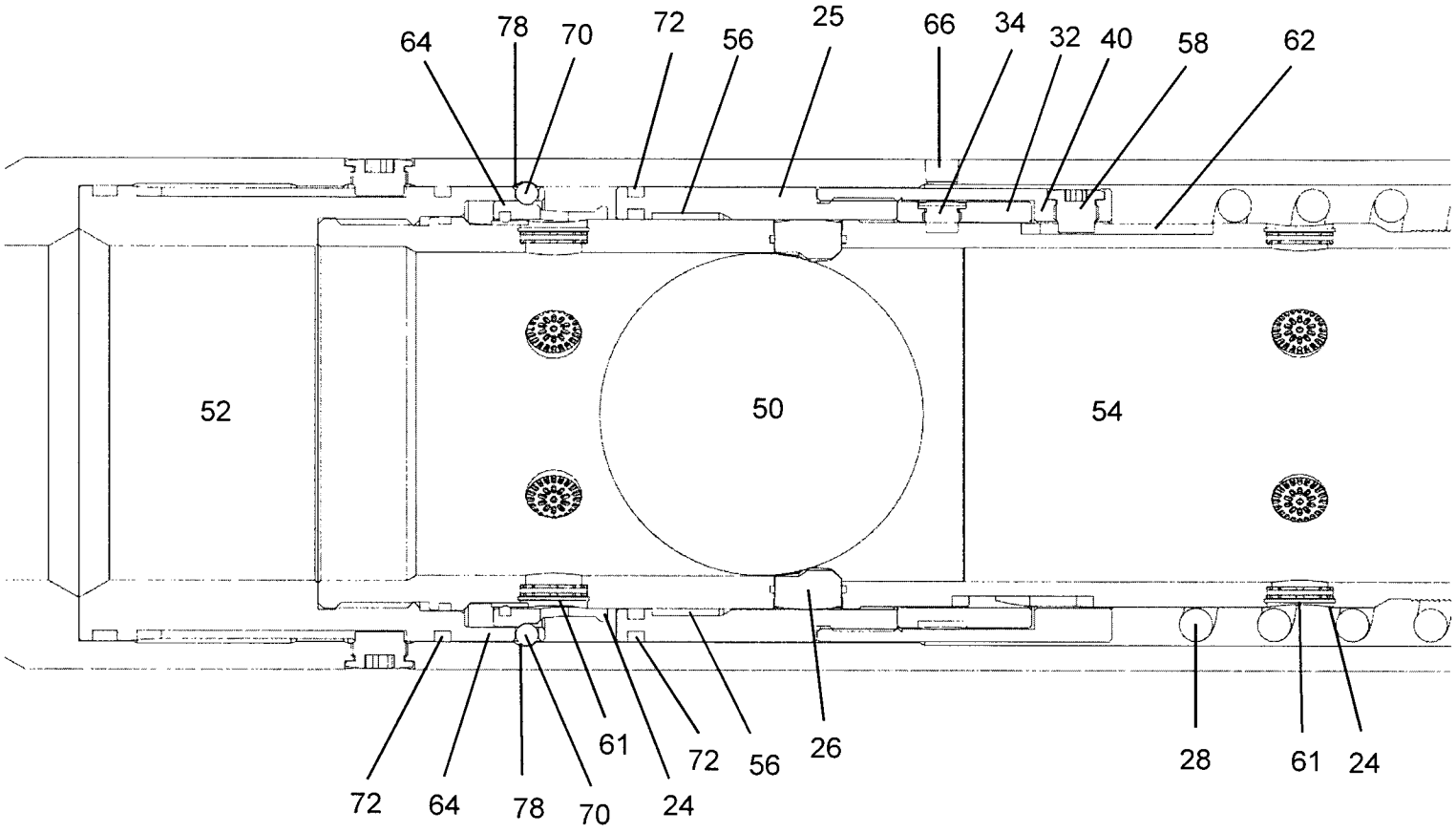
FIGS. 14A, 14B, 14C, 14D, 14E and 14F show cross sectional embodiments of a counting completion tool in use.
Figure 14B:
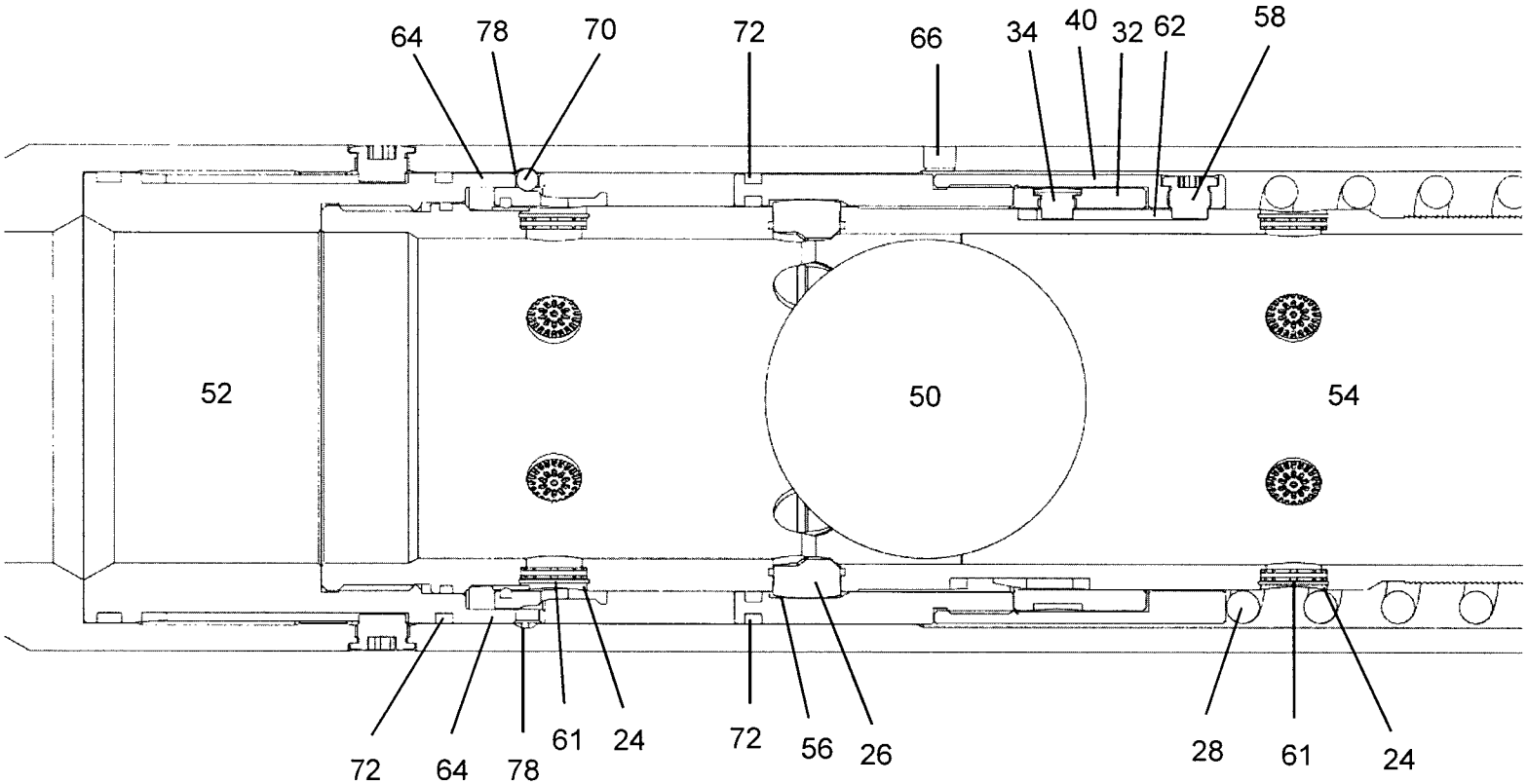

FIGS. 14A through 14F show the process by which an embodiment of fracing apparatus 10 can work in operation. Referring to FIG. 14A, actuating member 50 has been released through service/completion string 4, and has come to rest against expandable seat members 26, creating a high pressure zone 52 upstream of actuating member 50 as fracing fluid 8 is blocked, and a low pressure zone 54 downstream.

In some embodiments, bearings 70 in locking mechanism 64 can be in place in bearing grove 78, and accordingly, sleeve 12 is in a locked configuration and is not able to shift. When actuating member 50 lands, the high pressure fluid above the actuating member 50 is able to create a force (through holes 24 upstream of actuating member 50) to move the auto jay counting mechanism seat housing 25 and relief 56 down towards a low pressure area. During the forward motion, the auto-jay ring 32 and pin 34 can follow the counting track 38 in sleeve 12. If the track is long 44, seat housing 25 can travel far enough to allow the relief 56 to align with expandable seat members 26 as shown on FIG. 14B. Once aligned, members 26 can expand out and allow the actuating member 50 to pass.

Figure 14C:
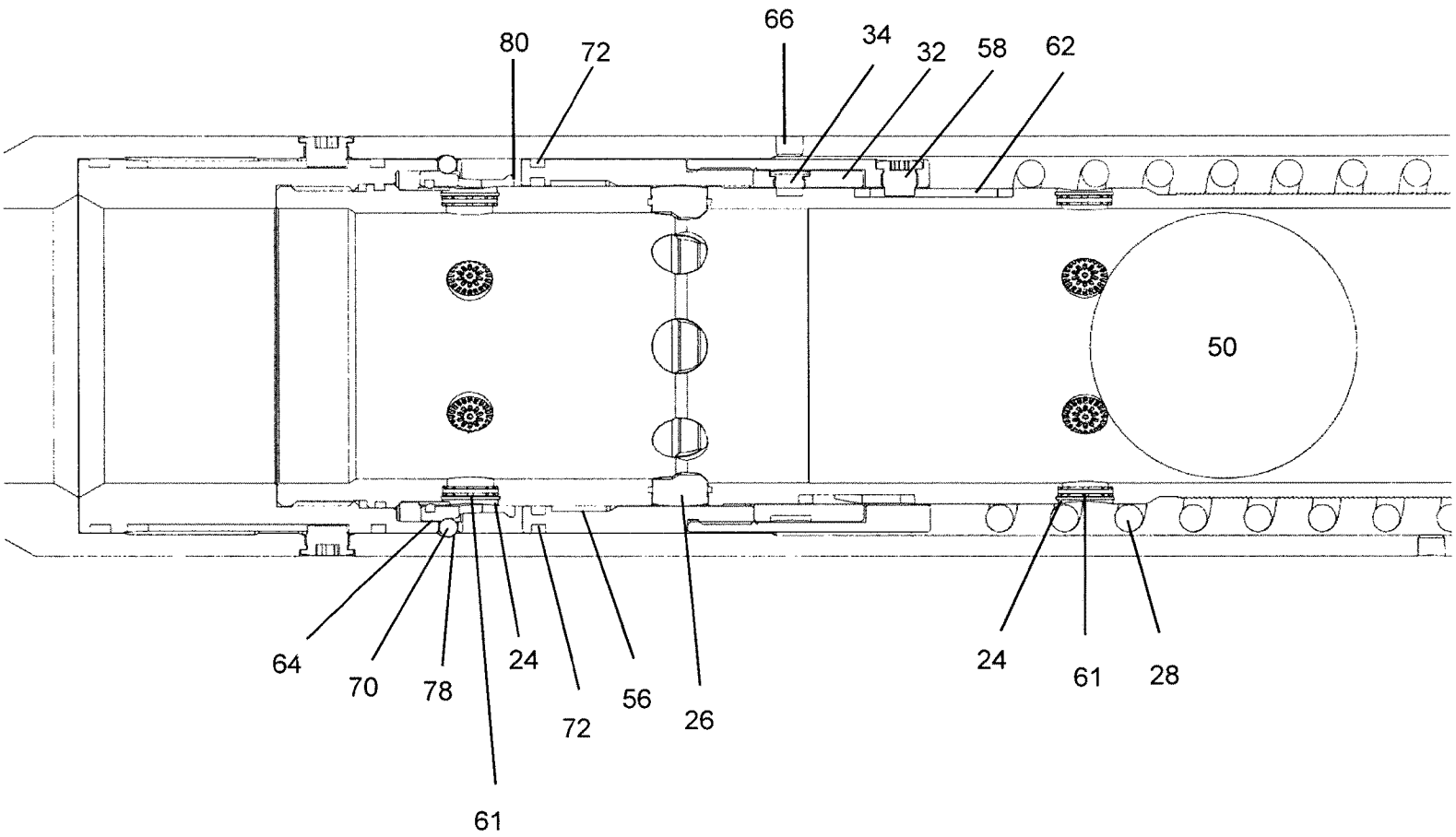

Referring to FIG. 14C, as actuating member 50 exits apparatus 10, the pressure within apparatus 10 equalizes through apertures 24, allowing biasing member 28 to reset. Pin 34 can then slide out of long groove 44 and is directed by teeth 45, which can cause auto-jay ring 32 to rotate within counting assembly housing 40 and align pin 34 with the adjacent groove. Auto-jay ring 32 can then be back in a position that collapses the expandable seat 26. If counting mechanism/assembly 22 is not in its final cycle, backswing groove 76 is not yet engaged and further upstream movement of actuation mechanism is prevented. As such, seat housing 25 does not meet front edge 80 of locking mechanism 64, and locking mechanism 64 remains in a locked configuration.

Figure 14D:
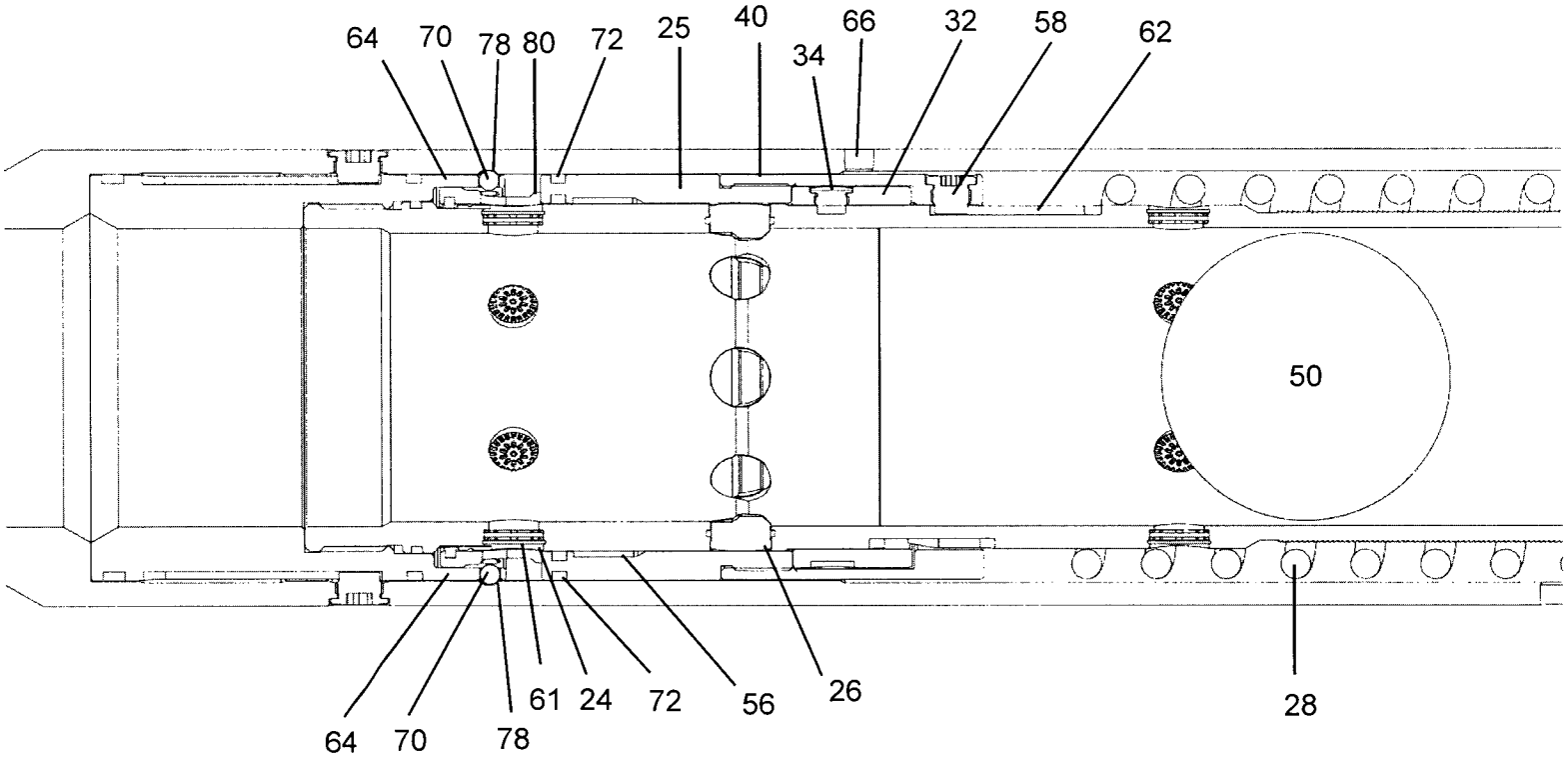

Referring to FIG. 14D, a subsequent actuating member 50 has entered and passed through fracing apparatus 10, however in this example, pin 34 is now aligned with backswing groove 76. This can allow biasing member 28 to move seat housing 25 to further upstream and meet front edge 80 of locking mechanism 64. As locking mechanism 64 is moved upstream, a space 88 is formed for bearing 70 to fall inward towards sleeve 12 and out of the bearing groove 78, causing the locking mechanism to disengage and allowing the shear pins 20 to see any forces that were previously blocked by the locking mechanism 64.

Figure 14E:
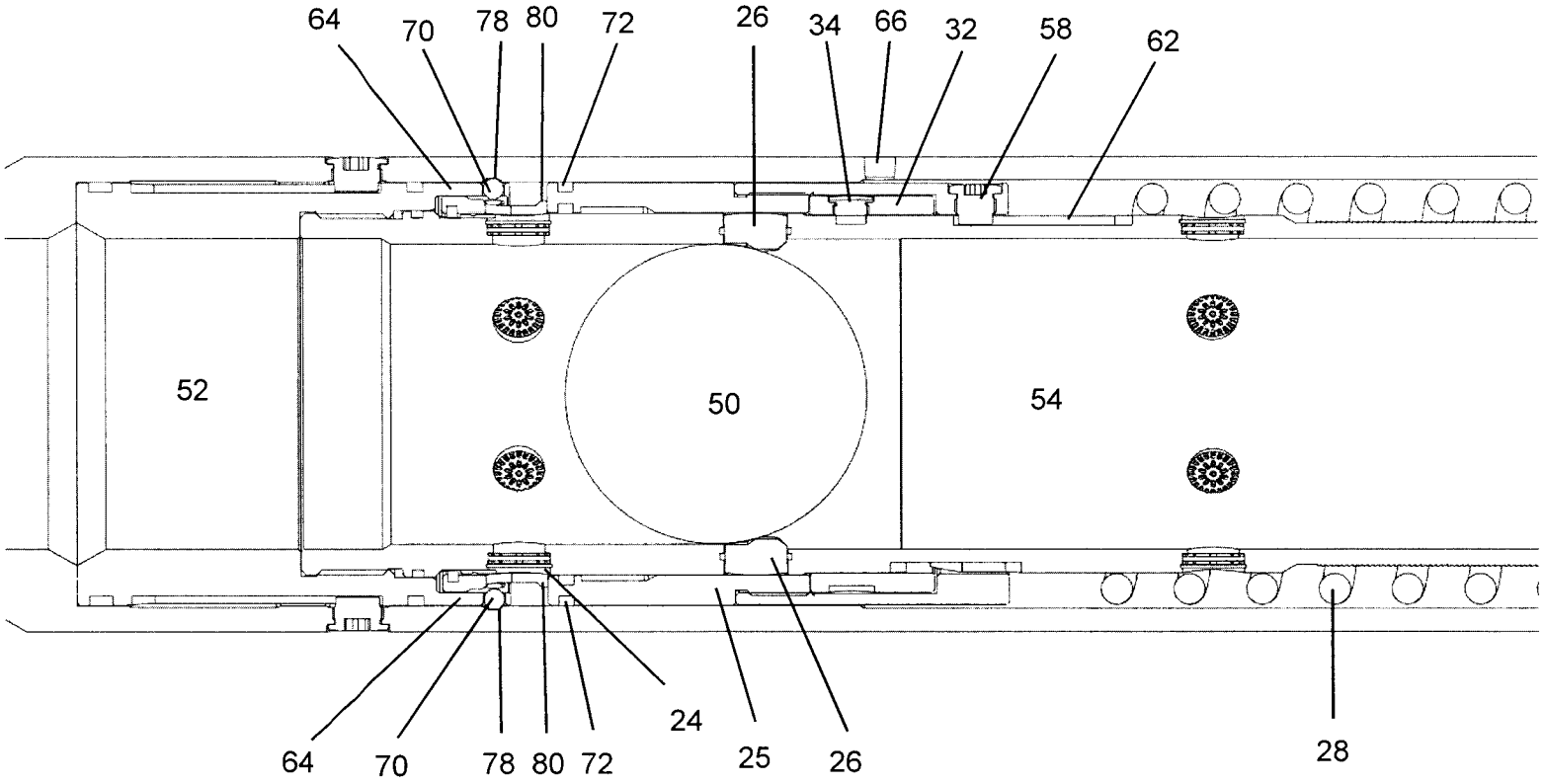
Figure 14F:
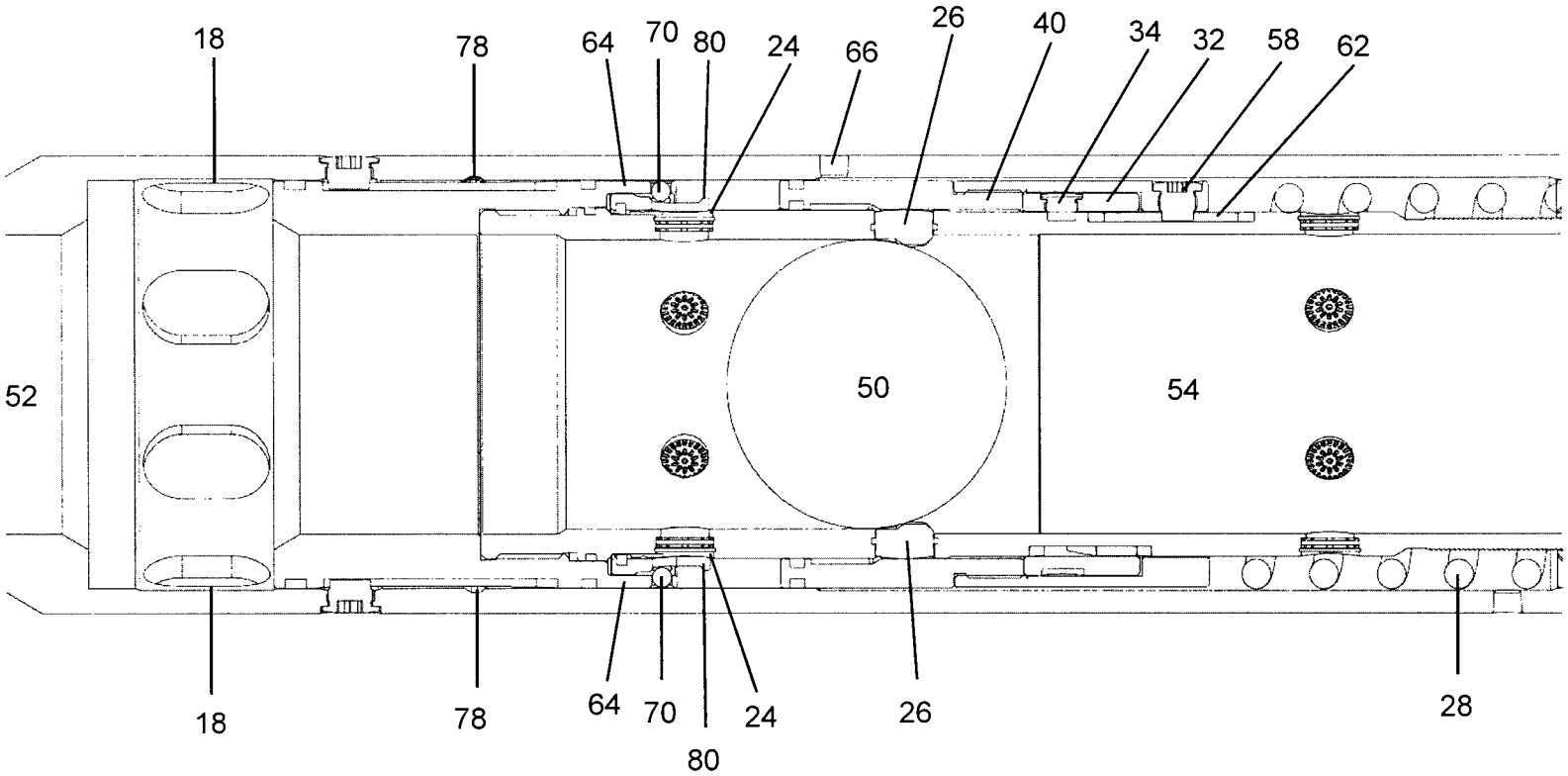

Referring to FIG. 14E and FIG. 14F, a subsequent actuating member 50 has entered fracing apparatus 10, however in this example, pin 34 is aligned with short groove 46. This prevents release relief 56 from aligning with expandable seat members 26 and therefore, expandable seat members do not allow actuating member 50 to pass. As actuating member 50 is unable to pass, upstream pressure increases causing shear pins 20 to see full force of the actuating member. Accordingly, locking mechanism 64 has now been unlocked and as locking mechanism 64 prevented sleeve 12 from moving downstream, once locking mechanism 64 is unlocked, sleeve 12 moves downstream, exposing flow ports 18 that were previously blocked by sleeve 12, and allowing the fracing fluid 8 to exit the fracing apparatus. As sleeve 12 moves downstream, ratchet ring 60 can meet with locking ratchet profile 42 and can prevent sleeve 12 from moving upstream, thus maintaining flow ports 18 in an open position.

Figure 15:
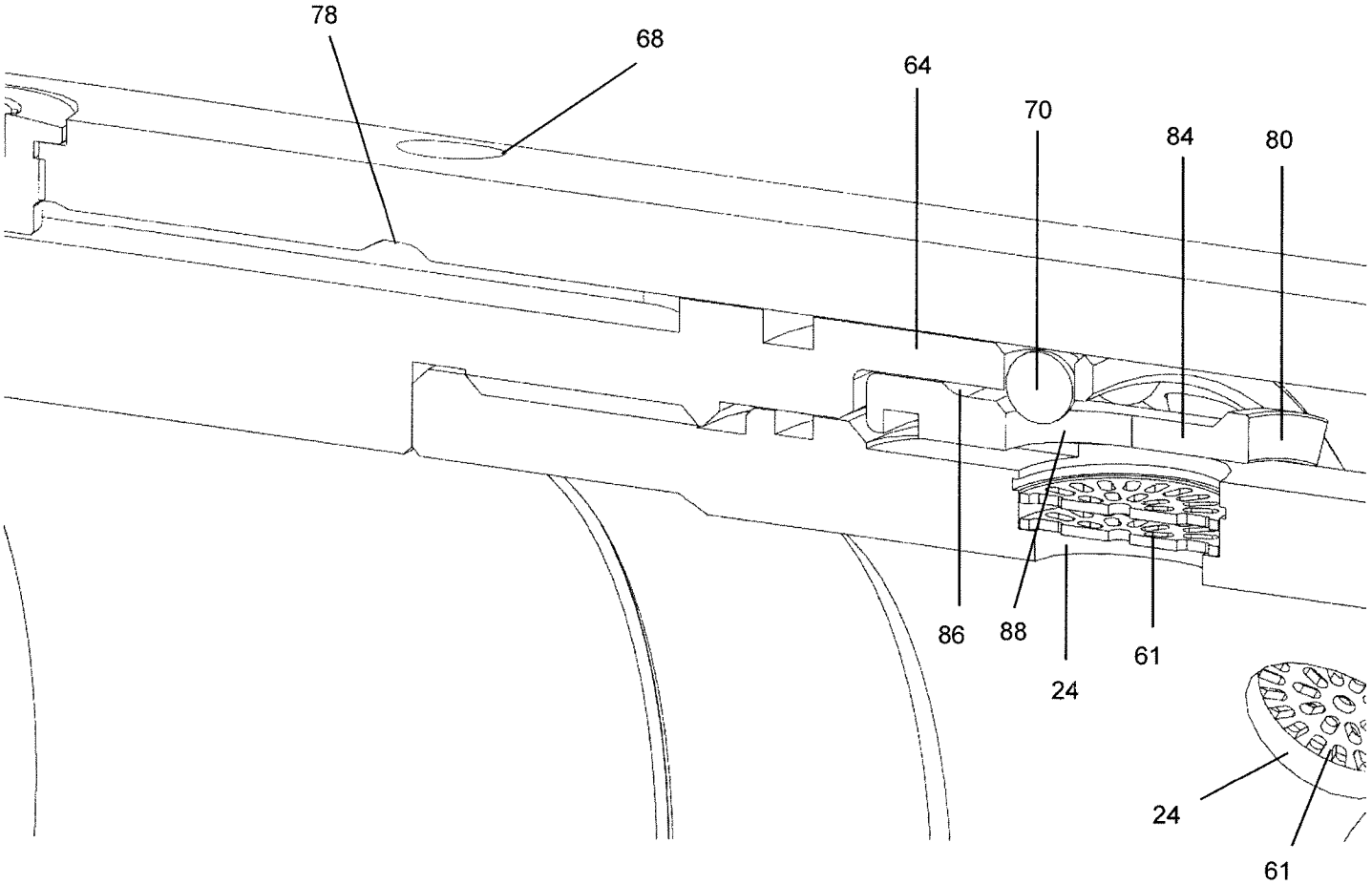
FIG. 15 is a cross sectional, close-up, side view of an embodiment of a locking assembly in a shifted position.

A close-up view of an embodiment of the unlocked (shifted) locking mechanism 64 can be seen in FIG. 15. Locking mechanism sub-ring 84 can be seen pushed upstream into locking mechanism 64 as a result of front edge 80 of locking mechanism 64 being moved upstream by seat housing 25 in response to biasing member 28. In the locked position, bearing 70 is usually held by ledge 86 of locking mechanism sub-ring 84 into bearing groove 78. When sub-ring 84 is moved upstream, ledge 86 gives way to space 88 and bearing 70 is allowed to come inward to sleeve 12, and away from bearing groove 78, thereby allowing locking mechanism 64 to be unlocked and move/shift downstream as required.

Figure 16:
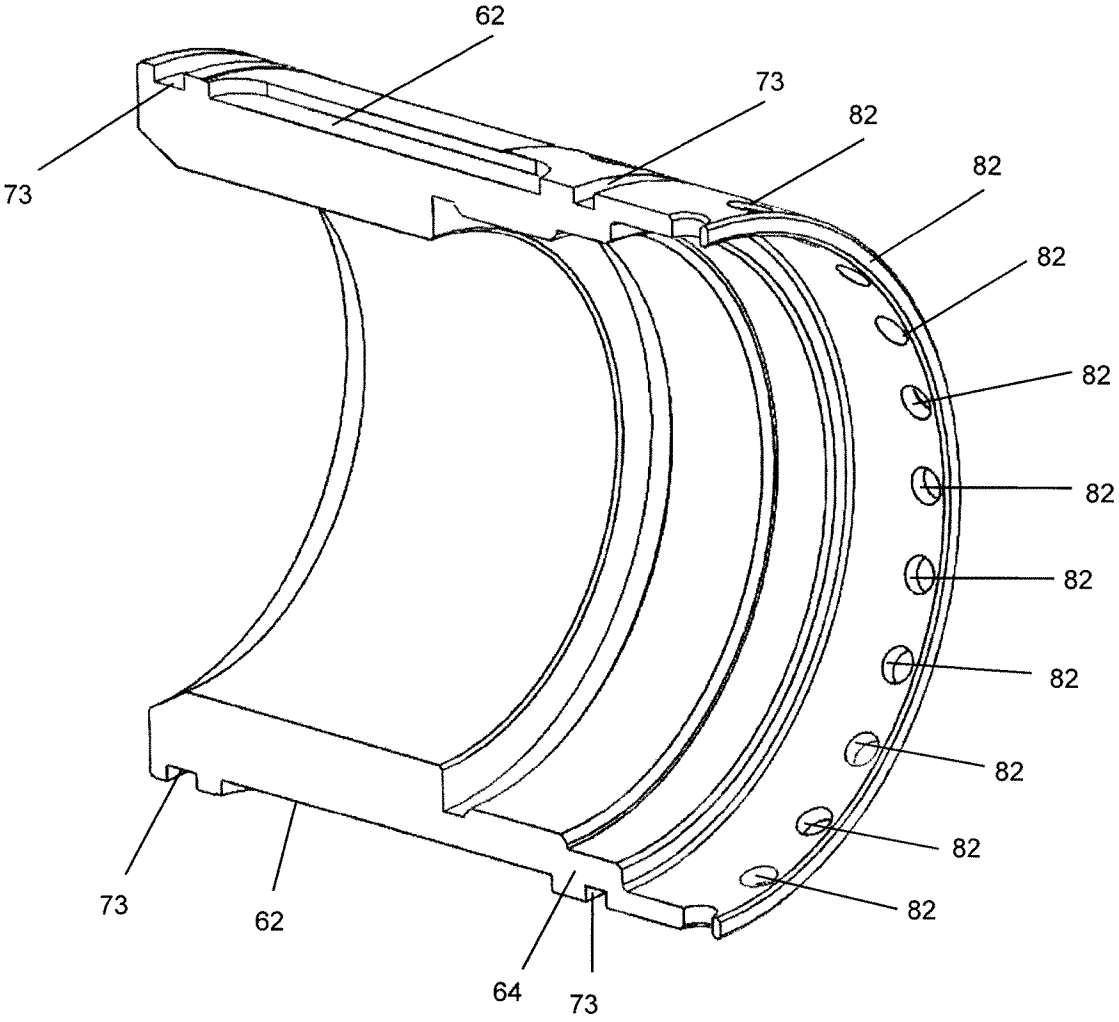
FIG. 16 is a cross sectional, close-up, side view of an embodiment of a shiftable sleeve with anti pre-set (locking) mechanism.

A cross section of an embodiment of locking mechanism 64 can be seen in FIG. 16. Seals 72 can be used in seal grooves 73 in order to separate areas of differing pressures. Bearing apertures 82 are configured to receive and hold bearings TO when locking mechanism 64 is in a locked position. An embodiment of apparatus 10 is shown in FIG. 17 where the upper housing 14 has been removed, Without any limitation to the foregoing, the present apparatuses and methods are further described by way of the following examples.

EXAMPLE 1

Testing Design:

A test was designed to simulate a twenty-one stage ball drop completion with a set of twenty-one apparatuses (tools) as described herein, forming a ball drop system. The tools were installed on a 4½" (114.3 mm) casing string and deployed into a vertical test well. Balls were dropped at varying fluid rates to test the pressure differentiating indicators at each tool, frac bail integrity, and system limitations. Balls were cycled through each tool, activating the system's counting mechanism until it reaches the intended port for activation.

Operational Data—Deployment of Tools:

The service rig ran the 4.5" string of P-110 casing with a toe port system at the bottom of the BHA and 21 tools, spaced out at predetermined intervals, along the string. A ball launching system was installed at surface to safely launch each frac ball.

All of the 4.5" tools were pinned to 1400 psi (9.65 mpa) Opening Pressure. Each tool was stamped with the min tool ID and the stage number of which it would be placed in the string. A 1000 psi annular pressure test was applied to the 95/8" casing prior to pressure testing the 4.5" tubing string.

With pressure sensors hooked to the wellhead, the frac balls were dropped in a sequential manner. Circulation was established for each stage and a pressure response to surface verified which stage had opened with each ball. Each stage was monitored at surface for pressure responses at a rate of 6 samples/second.

Tool Stages 1 through 3

Initiation of the twenty-one stages of the tools was proceeded with. For first stages 3×3.375" ID BDS ports were ran, which were activated with 3.500" balls. On stages #1 & #2 Protek™ E5HBM ball were ran. On stage #3 DD167 semi-dissolvable frac ball was ran. The 3 stages were pumped as Follows: 1) 1.0 m3/min 2) 1.0 m3/min 3) 2.0 m3/min.

On each stage, the pressure sensors graphed very definitive spikes as the balls passed through each stage, until it reached the intended activation port.

Figure 18:
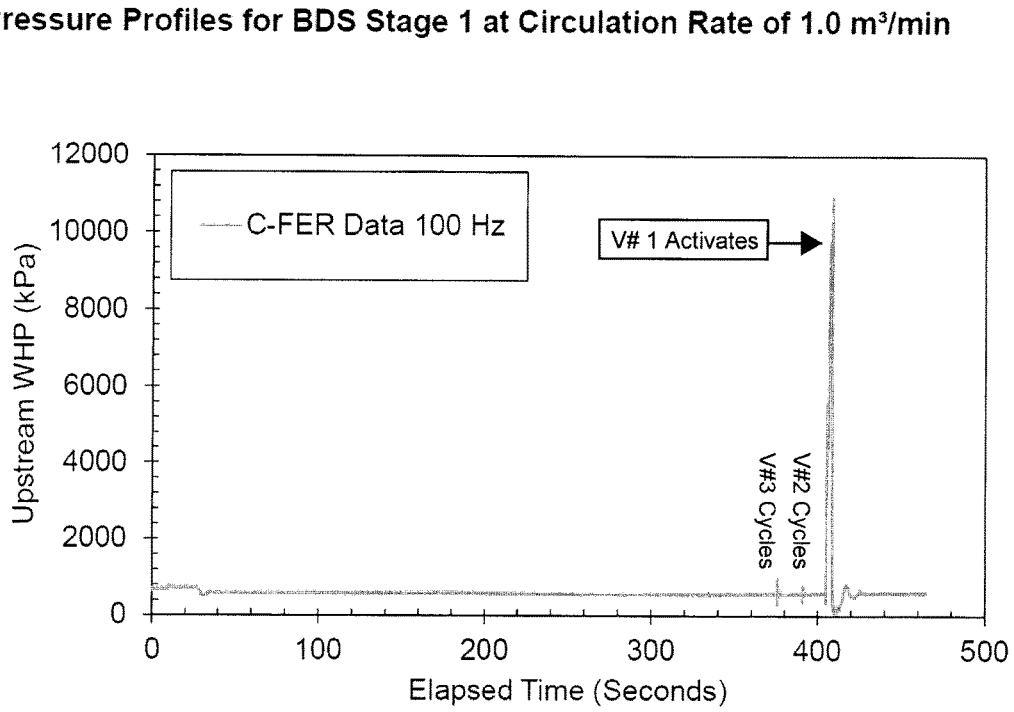
FIG. 18 is a graph which reflects the results of multiple counting completion tools in a completion system, showing pressure profiles of a first stage at a circulation rate of 1.0 $m^3$/min.

See FIG. 18 which is a graph reflecting the results of multiple counting completion tools in a completion system, showing pressure profiles of a first stage at a circulation rate of 1.0 $m^3$/min.

Tool Stages 4 through 10

For stages 4-10, 7×3.500" ID BDS ports were ran, which activated with 3.625" balls. The Protek™ E5HBM frac balls were used for these stages. Rates for each stage were as follows; 4). 1.0 m3/min 5) 1.0 m3/min 6) 1.0 m3/min 7) 1.5 m3/min 8) 1.5 m3/min 9) 1.5 m3/min 10) 2.0 m3/min.

Figure 19:
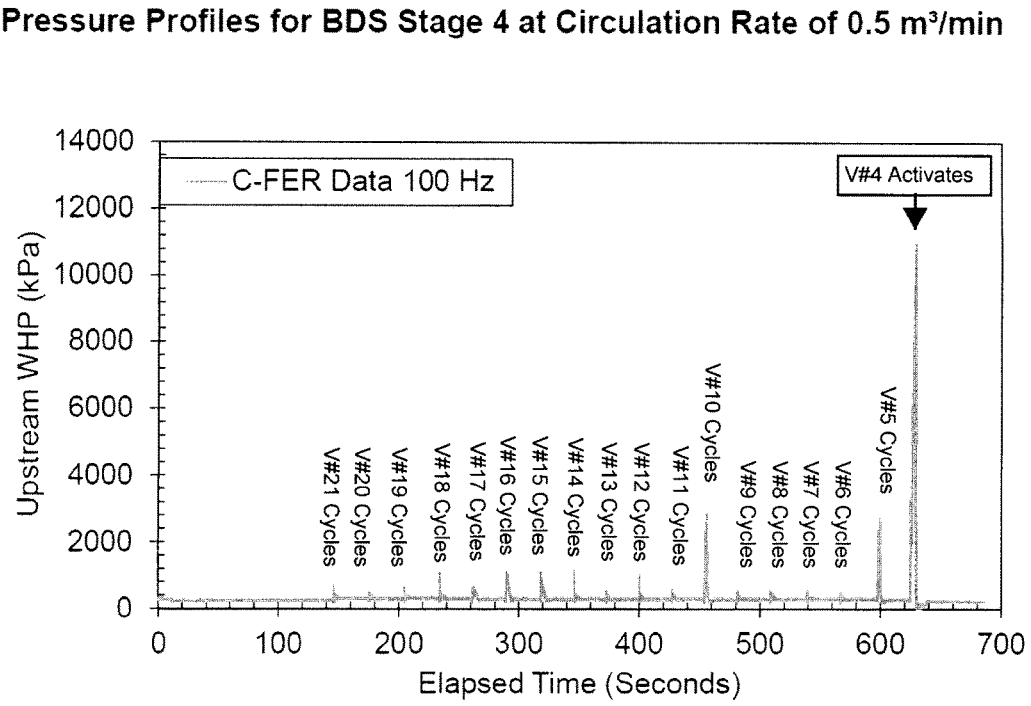
FIG. 19 is a graph which reflects the results of multiple counting completion tools in a completion system, showing pressure profiles of a fourth stage at a circulation rate of 0.5 $m^3$/min.

See FIG. 19 which is a graph reflecting the results of multiple counting completion tools in a completion system, showing pressure profiles of a fourth stage at a circulation rate of 0.5 $m^3$/min.

Test Tool Summary

Stages 1-3 @ 1.0 m3/min & 2.0 m3/min-3.375" ID of tool with 3.500' Ball: For stages 1-3, each tool valve was activated as planned. There were no anomalies to report.

Stages 4-21 @ 1.0 m3/min & 4.0 m3/min-3.500" ID with 3.625" Ball: For stages 4 through 19, each tool valve was activated as planned. There were no anomalies to report.

It was conclusive, between both tests on the tool system, that the system is capable of handling pumping rates of 4.0 m3/min or greater.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. An apparatus comprising:

a tubular housing for connecting in-line with a completion string, the housing having an upper end and a lower end, a wall defining an inner bore and an outer surface, and a flow port through the wall of the tubular housing operable for fluid communication of pressurized fluid from inside the tubular body to outside the tubular body;

an inner indexing mechanism disposed within the inner bore of the housing, the inner indexing mechanism comprising;

an indexing sleeve having an outer diameter with a counting track disposed around the outer diameter and operable to slide inside the tubular housing from a first position in which the flow port is blocked by the indexing sleeve to a second position in which the flow port is exposed;

a counting mechanism, configured for being moved through a plurality of positions, the counting mechanism comprising a pin and a ring for being disposed concentrically around the indexing sleeve, wherein the pin is configured for tracing the counting track; and a biasing member configured to urge the counting mechanism to trace the counting track; and an actuating mechanism disposed within the indexing sleeve and configured to overcome the biasing member and move the counting mechanism through a plurality of positions, the actuating mechanism being configured to be activated by an accordingly sized actuating member.

2. The apparatus of claim 1, wherein the counting track comprises a series of axial auto-jay grooves.

3. The apparatus of claim 2, wherein the series of axial auto-jay grooves further comprise a backswing groove to allow the counting mechanism to undergo a backswing prior to entering an active position.

4. The apparatus of claim 1, wherein the actuating mechanism comprises an expandable seat in the indexing sleeve; wherein the expandable seat is configured to either receive and release, or receive and retain, the accordingly sized actuating member dependent on a predetermined position of the counting mechanism.

5. The apparatus of claim 4, wherein the expandable seat is a split collet.

6. The apparatus of claim 4, wherein the expandable seat comprises an expandable seat housing and dogs which extend radially into the inner bore to create a seat.

7. The apparatus of claim 6, wherein the dogs are angled to cradle the actuating member and increase the contact area between the dogs and the actuating member.

8. The apparatus of claim 1, wherein the actuating member is configured for activating the actuating mechanism as well as moving the inner indexing mechanism to a predetermined position.

9. The apparatus of claim 1, wherein the series of axial auto-jay grooves comprises a series of grooves configured for maintaining the inner indexing mechanism in an inactive position and at least one groove for activating the inner mechanism.

10. The apparatus of claim 1, wherein the counting mechanism is configured to progress within the auto-jay grooves towards an active groove in a predetermined number of steps by passage of a corresponding number of actuating members through the actuating mechanism.

11. The apparatus of claim 1, wherein the biasing member is a spring.

12. The apparatus of claim 1, wherein the biasing member is compressed fluid.

13. The apparatus of claim 1, wherein the actuating member is selected from the group consisting of a ball, a plug, and a dart.

14. The apparatus of claim 1, further comprising a locking mechanism for preventing the sleeve from shifting prematurely.

15. A method of fracturing a wellbore, method comprising:

creating an isolated wellbore segment around an apparatus according to claim 1 positioned in line with a completion string within the wellbore;

passing an accordingly sized actuating member through the completion string to the apparatus to activate the actuating mechanism;

opening the flow port of the apparatus; and providing pressurised fluid to the apparatus to exit the opened flow port;

wherein the wellbore is thereby fractured by the pressurized fluid.

16. The method of claim 15, wherein the actuating member is configured to activate the actuating mechanism as well as configured to move the inner indexing mechanism.

17. The method of claim 15, wherein when the counting mechanism is positioned in an inactive groove within the series of grooves, the expandable seat is configured to receive and release the corresponding actuating member.

18. The method of claim 15, wherein when the counting mechanism is positioned in an active groove within the series of grooves, the expandable seat is configured to receive and retain the corresponding actuating member.

19. The method of claim 15, wherein the inner indexing mechanism is movable by landing an actuating member in an expandable seat that is configured to receive and retain the actuating member.

20. The method of claim 15, further comprising:

creating an additional isolated wellbore segment around an additional apparatus according to claim 1 positioned in line with a completion string within the wellbore;

passing an additional accordingly sized actuating member through the completion string to the additional apparatus to activate the actuating mechanism;

opening the flow port of the additional apparatus; and providing pressurised fluid to the additional apparatus to exit the opened flow port;

wherein the wellbore is thereby fractured in a targeted manner by the pressurized fluid.

21. A method for actuating a downhole tool to an active position, the method comprising (a) placing an actuating member onto an actuating mechanism disposed within the tool;

(b) generating a pressure difference upstream versus downstream of the actuating member;

(c) moving a counting mechanism against a biasing member into an inactive auto-jay groove disposed on an outer diameter of a sliding sleeve assembly by a force created through actuation apertures positioned around the circumference of the sleeve assembly;

(d) releasing the actuating member from the actuating mechanism;

(e) biasing the counting mechanism away from the biasing member along a groove of a series of axial auto-jay grooves;

(f) repeating above steps (a)-(e) until the counting mechanism reaches an active groove, whereby the downhole tool is actuated to an active position.

* * * * *